US010943725B2

(12) United States Patent
Chatani et al.

(10) Patent No.: US 10,943,725 B2
(45) Date of Patent: Mar. 9, 2021

(54) SHEET-SHAPED INDUCTOR, INDUCTOR WITHIN LAMINATED SUBSTRATE, AND METHOD FOR MANUFACTURING SAID INDUCTORS

(71) Applicant: TOKIN CORPORATION, Sendai (JP)

(72) Inventors: Kenichi Chatani, Sendai (JP); Naoharu Yamamoto, Sendai (JP); Shigeyoshi Yoshida, Sendai (JP)

(73) Assignee: TOKIN CORPORATION, Sendai (JP)

( * ) Notice: Subject to any disclaimer, the term of this patent is extended or adjusted under 35 U.S.C. 154(b) by 159 days.

(21) Appl. No.: 16/132,356

(22) Filed: Sep. 14, 2018

(65) Prior Publication Data

US 2019/0043654 A1 Feb. 7, 2019

Related U.S. Application Data

(62) Division of application No. 14/422,679, filed as application No. PCT/JP2013/074352 on Sep. 10, 2013, now abandoned.

(30) Foreign Application Priority Data

Sep. 10, 2012 (JP) ..... 2012-198844

(51) Int. Cl.
*H01F 27/24* (2006.01)
*H01F 27/245* (2006.01)
(Continued)

(52) U.S. Cl.
CPC ..... *H01F 27/245* (2013.01); *H01F 17/0013* (2013.01); *H01F 17/0033* (2013.01);
(Continued)

(58) Field of Classification Search
CPC ..... H01F 3/08; H01F 27/245; H01F 27/2804; H01F 27/255; H01F 41/06; H01F 41/0233; Y10T 29/4917; Y10T 29/49071
(Continued)

(56) References Cited

U.S. PATENT DOCUMENTS 3,731,005 A * 5/1973 Shearman ..... G11B 5/295 360/123.01
5,574,420 A * 11/1996 Roy ..... H01F 17/0033 336/200
(Continued)

FOREIGN PATENT DOCUMENTS

CN 1522449 A 8/2004
CN 101238530 A 8/2008
(Continued)

OTHER PUBLICATIONS

Chinese Office Action (and English translation thereof) dated Jun. 15, 2016, issued in counterpart Chinese Application No. 201380043958.2.
(Continued)

*Primary Examiner* — Mang Tin Bik Lian
(74) *Attorney, Agent, or Firm* — Holtz, Holtz & Volek PC

(57) ABSTRACT

A laminated substrate embedded type inductor includes a laminated resin substrate in which a pair of first resin substrates are laminated, a sheet-shaped magnetic core placed in the laminated resin substrate, via holes provided so as to pass through the laminated resin substrate, and a coil formed via the via holes. The laminated resin substrate contains an adhesive component, wherein the sheet-shaped magnetic core is a molded body obtained by forming a soft magnetic flat metal powder into a flat plate, the soft magnetic flat metal powder is oriented in a plane of the flat plate, and a generated magnetic flux of the coil circulates in the plane of the flat plate, and wherein the magnetic core is
(Continued)

integrated with the laminated resin substrate so that the adhesive component is impregnated in pores of the magnetic core.

16 Claims, 17 Drawing Sheets

(51) Int. Cl.

| | |
|---|---|
| ***H01F 17/00*** | (2006.01) |
| ***H01F 41/04*** | (2006.01) |
| ***H01F 27/255*** | (2006.01) |
| ***H01F 27/28*** | (2006.01) |
| ***H01F 41/02*** | (2006.01) |
| ***H01F 41/06*** | (2016.01) |
| *H01F 1/26* | (2006.01) |

(52) U.S. Cl.
CPC ..... *H01F 27/255* (2013.01); *H01F 27/2804* (2013.01); *H01F 41/0233* (2013.01); *H01F 41/046* (2013.01); *H01F 41/06* (2013.01); *H01F 1/26* (2013.01); *Y10T 29/49071* (2015.01); *Y10T 29/49117* (2015.01)

(58) Field of Classification Search
USPC ..... 336/233, 223, 200, 218
See application file for complete search history.

(56) References Cited

U.S. PATENT DOCUMENTS

| | | | | |
|---|---|---|---|---|
| 6,094,123 | A * | 7/2000 | Roy | H01F 27/292 336/185 |
| 6,647,093 | B2 | 11/2003 | Schmitz et al. | |
| 6,803,848 | B2 | 10/2004 | Yeo et al. | |
| 6,930,584 | B2 | 8/2005 | Edo et al. | |
| 7,719,399 | B2 * | 5/2010 | Iwasaki | H01F 17/0013 336/200 |
| 7,859,377 | B2 | 12/2010 | Kawarai | |
| 7,938,915 | B2 | 5/2011 | Kanekiyo et al. | |
| 8,624,701 | B2 | 1/2014 | Zeng et al. | |
| 2004/0196132 | A1 | 10/2004 | Yu et al. | |
| 2004/0219328 | A1 | 11/2004 | Tasaki et al. | |
| 2004/0263308 | A1 | 12/2004 | Yu et al. | |
| 2006/0109071 | A1 * | 5/2006 | Thongsouk | H05K 1/165 336/200 |
| 2006/0132273 | A1 | 6/2006 | Shinmen et al. | |
| 2006/0145804 | A1 * | 7/2006 | Matsutani | H01F 27/027 336/200 |
| 2006/0272850 | A1 | 12/2006 | Morimoto et al. | |
| 2007/0169851 | A1 | 7/2007 | Kugai et al. | |
| 2007/0190360 | A1 | 8/2007 | Sakamoto | |
| 2008/0136575 | A1 | 6/2008 | Edo et al. | |
| 2008/0143468 | A1 | 6/2008 | Yokoyama et al. | |
| 2008/0231402 | A1 | 9/2008 | Jow et al. | |
| 2009/0002117 | A1 | 1/2009 | Kawarai | |
| 2009/0127494 | A1 | 5/2009 | Kanekiyo et al. | |
| 2009/0197063 | A1 | 8/2009 | Uchikiba et al. | |
| 2009/0243780 | A1 | 10/2009 | Inoue et al. | |
| 2009/0322461 | A1 * | 12/2009 | Hebert | H01F 17/0033 336/83 |
| 2010/0026443 | A1 | 2/2010 | Yan et al. | |
| 2010/0171579 | A1 | 7/2010 | Yan et al. | |
| 2010/0308949 | A1 * | 12/2010 | Lim | H01F 17/04 336/218 |
| 2011/0027557 | A1 | 2/2011 | Kirby et al. | |
| 2011/0037557 | A1 | 2/2011 | Konoue et al. | |
| 2011/0291789 | A1 | 12/2011 | Dalmia et al. | |
| 2012/0256118 | A1 | 10/2012 | Nakamura | |
| 2013/0038419 | A1 * | 2/2013 | Kobayashi | H01F 1/24 336/200 |
| 2013/0113591 | A1 | 5/2013 | Yan et al. | |
| 2013/0113592 | A1 | 5/2013 | Yan et al. | |
| 2013/0335186 | A1 * | 12/2013 | Chang | H01F 27/292 336/200 |
| 2014/0043130 | A1 | 2/2014 | Dalmia et al. | |

FOREIGN PATENT DOCUMENTS

| | | | | |
|---|---|---|---|---|
| GB | 1218681 | A | | 1/1971 |
| GB | 2461443 | A | | 1/2010 |
| GB | 2485318 | A | | 5/2012 |
| JP | 56157011 | A | | 12/1981 |
| JP | 0446570 | U | | 4/1992 |
| JP | 05121242 | A | | 5/1993 |
| JP | 10303043 | A | | 11/1998 |
| JP | 11067575 | A | * | 3/1999 |
| JP | H1167575 | A | | 3/1999 |
| JP | 11176680 | A | | 7/1999 |
| JP | 2000021664 | A | | 1/2000 |
| JP | 2001358419 | A | | 12/2001 |
| JP | 2002057043 | A | | 2/2002 |
| JP | 2002289419 | A | | 10/2002 |
| JP | 2004143554 | A | | 5/2004 |
| JP | 2004247663 | A | | 9/2004 |
| JP | 2007012863 | A | | 1/2007 |
| JP | 2007088356 | A | | 4/2007 |
| JP | 2007208026 | A | | 8/2007 |
| JP | 2007220747 | A | | 8/2007 |
| JP | 2008066671 | A | | 3/2008 |
| JP | 2008066672 | A | | 3/2008 |
| JP | 2009009985 | A | | 1/2009 |
| JP | 2011129798 | A | | 6/2011 |
| JP | 2011530172 | A | | 12/2011 |
| WO | 2008133018 | A1 | | 11/2008 |

OTHER PUBLICATIONS

International Search Report (ISR) dated Dec. 17, 2013 issued in International Application No. PCT/JP2013/074352.

Japanese Office Action (and English translation thereof) dated Apr. 6, 2016, issued in counterpart Japanese Application No. 2012-198844.

Chinese Office Action (and English language translation thereof) dated Sep. 9, 2020 issued in Chinese Application No. 201811328186.8.

* cited by examiner

FIG. 14A
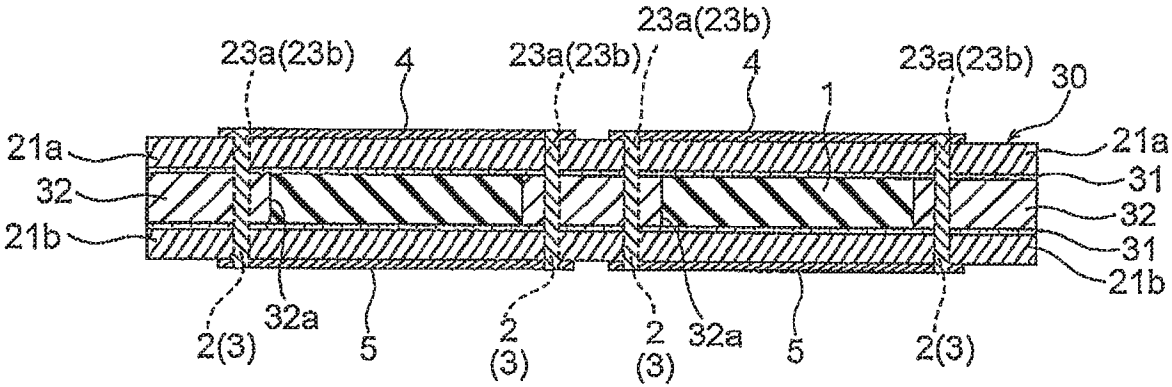
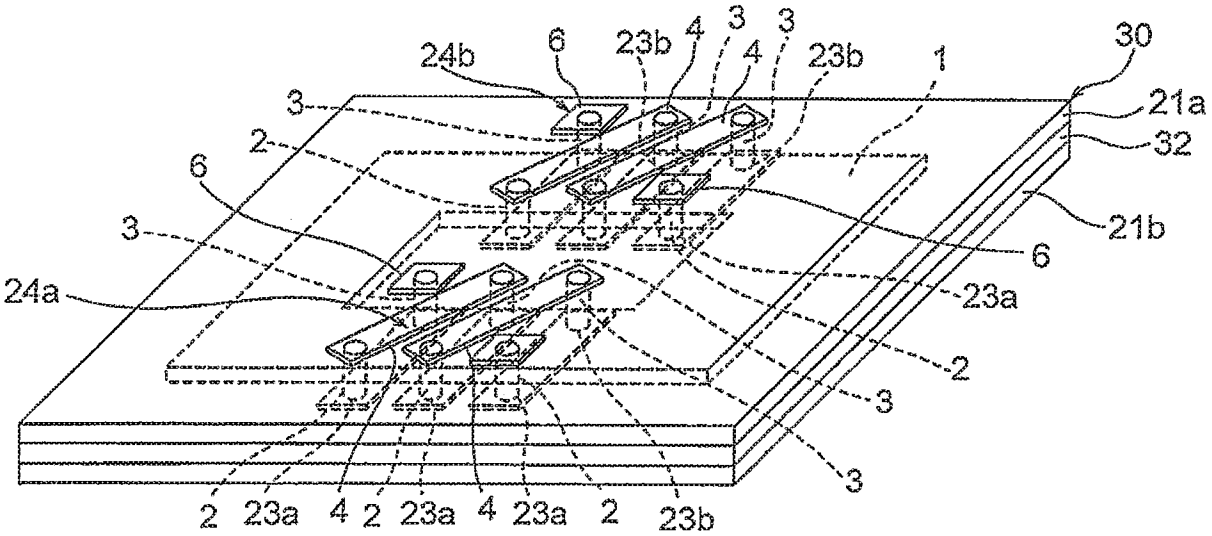
FIG. 14B

SHEET-SHAPED INDUCTOR, INDUCTOR WITHIN LAMINATED SUBSTRATE, AND METHOD FOR MANUFACTURING SAID INDUCTORS

CROSS-REFERENCE TO RELATED APPLICATIONS

This application is a Divisional application of U.S. application Ser. No. 14/422,679, filed Feb. 19, 2015, which is a U.S. National Phase application of International Application Serial No. PCT/JP2013/074352, filed Sep. 10, 2013. International Application No. PCT/JP2013/074352 is based on and claims priority from Japanese Patent Application Serial No. 2012-198844, filed Sep. 10, 2012. The entire contents of all the above-identified applications are incorporated herein by reference.

TECHNICAL FIELD

This invention relates to an inductor component and specifically relates to a sheet-shaped inductor for use in a power supply circuit of a small electronic device and to an inductor embedded in a laminated substrate.

BACKGROUND ART

Conventionally, as an inductor configured so that the magnetic flux generated in a magnetic core circulates in the plane of a flat plate formed by the magnetic core, there are ones shown in Patent Literatures 1, 2, and 3.

A magnetic substrate (inductor) disclosed in Patent Literature 1 includes a magnetic core composed of a plurality of thin sheets laminated vertically. The magnetic core has holes passing through the magnetic core vertically. By forming plated seed layers on surfaces and in the holes of the magnetic core, a coil conductor (coil) is formed.

Patent Literature 2, FIGS. 1 and 2 discloses an inductor in which silver-paste coil conductors are filled in through holes of a laminate in which flat metal powder sintered body layers and insulator layers are alternately laminated, and the coil conductors at front and back surfaces of the laminate are connected to each other via silver-paste connecting conductors, thereby forming a coil.

Patent Literature 3, paragraph [0024] and FIG. 1 discloses a structure in which a Finemet (registered trademark) core is fixed at its outer periphery by a cylindrical insulating member and sandwiched at its both ends between insulating plates and a stud coil is wound around the Finemet core to form a coil.

PRIOR ART LITERATURE

Patent Literature

Patent Literature 1: JP-A-2008-66671
Patent Literature 2: JP-A-2002-289419
Patent Literature 3: JP-A-2002-57043
Patent Literature 4: JP-A-2011-129798

SUMMARY OF INVENTION

Problem to be Solved by the Invention

In the inductors of Patent Literatures 1, 2, and 3, at least one of the following measures (a), (b), (c), and so on is taken in order to form a coil portion while preventing damage of a magnetic core in the manufacture or/and ensuring the insulation.

(a) To use a high-resistance soft magnetic ceramic material as a magnetic core material;

(b) To use a plated film or a printed conductor as a winding;

(c) To provide an insulating member between a coil and a magnetic core material.

However, the measures (a) to (c) described above have a drawback in terms of miniaturization, large-current adaptation, or manufacturing cost of an inductor.

Specifically, if a pressing force is applied when printing a conductor or when joining conductors (via conductors) provided in through holes to each other, a ferrite sintered body is easily cracked.

Further, in the inductors of Patent Literatures 1 and 2, since a conductor is printed, there is a drawback in that it is not possible to thicken a winding or to achieve a low resistance.

Further, in the case of a metal magnetic core of Patent Literature 3, for example, a material such as Finemet, MHz excitation is difficult due to eddy current. Then, if a powder molded body is used for improving this, although the frequency characteristics are improved, there is a drawback in that the magnetic permeability is as low as about 50 and thus that the magnetic properties are poor.

As a coil component for use in a power supply circuit of an electronic device, there is known a coil component embedded in a laminated resin substrate. In the case of such a coil component, in order to obtain a high inductance, (d) a cavity is provided inside the laminated resin substrate and a magnetic core composed of a magnetic body or a coil is enclosed in the cavity.

Further, as another measure, (e) a magnetic layer composed of an amorphous or deposited magnetic film is provided inside or outside the laminated resin substrate to form a magnetic core.

Further, as another measure, (f) part of substrate layers forming a laminated resin substrate is formed as a substrate layer made of a resin containing a magnetic powder. As the measure (f) described above, Patent Literature 4, FIGS. 3 and 8 discloses a laminated resin substrate including a resin layer containing a flattened high-frequency metal soft magnetic material such as Co—Fe.

In the case where the magnetic core or the coil component is embedded according to the measure (d) described above, it is necessary to provide an air gap around the magnetic core or the coil component enclosed in the cavity in the laminated resin substrate in order to prevent the stress from being applied to the magnetic core or the coil component from the substrate. However, due to this air gap, when the magnetic core or the coil component is embedded, there is a problem in that the components may be broken or a joining failure may occur if a pressing force is applied. Therefore, since the resin substrate layers and the magnetic core or the coil component cannot be adhered or integrated to each other, there is a problem in that a joining failure may occur to reduce the reliability of the entire laminated resin substrate.

When a ferrite is used as a magnetic body for the magnetic core of the coil component, while the ferrite is excellent in inductance and high-frequency characteristics compared to a metal material, it has a drawback in that the saturation magnetic flux density is low compared to the metal material.

Further, when the ferrite is used, the via-hole machining after lamination cannot be carried out so that it is difficult to form a coil current path passing through the magnetic body embedded in the resin substrate. After being laminated and enclosed, it is practically impossible to provide a through hole in the ferrite embedded in the resin substrate.

According to the measure (e) described above of providing as the magnetic core the magnetic layer composed of the amorphous or deposited magnetic film inside or outside the laminated resin substrate, there is a problem in that it is not possible to simultaneously ensure a sufficient magnetic body volume and reduce a magnetic loss at 1 MHz or more. Further, when the magnetic layer composed of the amorphous ribbon or the deposited magnetic film is embedded, there is also a drawback in that the magnetic layer is too thin to ensure a necessary volume, resulting in the occurrence of magnetic saturation. Further, the amorphous ribbon or the deposited magnetic film is primarily thin due to restriction on its manufacturing method and even if the ribbons or films are laminated to ensure a necessary volume, there is a drawback in that the eddy current loss is so large as to disable use at a frequency of 1 MHz or more, or a drawback in that superimposition characteristics of a magnetic core cannot be improved.

According to the measure (f) described above of using the substrate containing the magnetic powder, there is a problem in that while the required magnetic permeability is 50 or more and preferably 100 or more, a sufficiently large magnetic permeability exceeding 100 cannot be obtained.

Further, there is a drawback in that the electric resistance of a conductor of a coil component cannot be made small. If a double-sided copper foil substrate is formed with a coil pattern to gain a cross-sectional area, the skin effect decreases correspondingly.

As described above, according to any of the conventional measures, there is no suggestion that a soft magnetic material with a magnetic permeability of 100 or more can be formed and enclosed in a laminated resin substrate by applying a pressing force to a base member of the laminated resin substrate and also to the soft magnetic material. Further, there is no prior example in which a means for enabling such a structure or an internal structure of a magnetic core composed of a magnetic body is disclosed.

Therefore, it is a technical object of this invention to provide a magnetic core and a sheet-shaped inductor, which improve the magnetic properties and reliability and achieve a reduction in electric resistance and simplification of a manufacturing method.

It is another technical object of this invention to provide a laminated circuit substrate having an inductor that achieves space saving, a reduction in loss, an increase in inductance, adaptation to large-current conduction, small electric resistance, and reliability.

Means for Solving the Problem

According to this invention, there is provided a magnetic core comprising a molded body sheet of a mixture containing a soft magnetic flat metal powder and a binder, wherein the soft magnetic flat metal powder is oriented two-dimensionally in a flat plane of the molded body sheet.

In addition, according to this invention, there is provided a sheet-shaped inductor comprising: a magnetic core; and a coil, wherein the magnetic core has a predetermined thickness, two flat surfaces facing each other in the thickness direction, and two side surfaces connecting the two flat surfaces to each other; a first via hole provided between the two flat surfaces; and a second via hole provided between the two flat surfaces at a position spaced apart from the first via hole, wherein the coil comprises a first and a second via conductor provided so as to respectively pass through the first and second via holes; and a first and a second surface conductor respectively provided on the two flat surfaces of the magnetic core, wherein the first and second via conductors each have a central conductor and plug portions at both ends thereof, and wherein the first and second surface conductors are joined to the first and second via conductors via the plug portions.

Furthermore, according to this invention, there is provided a method of manufacturing a magnetic core, comprising the step of forming a molded body sheet by forming a mixture containing a soft magnetic flat metal powder and a binder into a sheet so that the soft magnetic flat metal powder is oriented in a flat plane formed by the molded body sheet.

Moreover, according to this invention, there is provided a method of manufacturing a sheet-shaped inductor, comprising: a perforating step of providing a first and a second via hole spaced apart from each other and passing through, in the lamination direction, two surfaces facing each other of a magnetic core; a via conductor forming step of forming a first and a second via conductor respectively passing through the first and second via holes; and a coil forming step of placing a first and a second surface conductor on the first and second via conductors and pressing the first and second surface conductors in the thickness direction of the magnetic core to form plug portions, formed by the first and second via conductors, in the first and second surface conductors, thereby joining together the first and second surface conductors and the first and second via conductors to establish electrical connection therebetween.

In addition, according to this invention, there is provided a laminated substrate embedded type inductor comprising: a laminated resin substrate in which a pair of first resin substrates are laminated; a sheet-shaped magnetic core placed in the laminated resin substrate; via holes provided so as to pass through the laminated resin substrate; and a coil formed via the via holes, wherein the laminated resin substrate contains an adhesive component, wherein the sheet-shaped magnetic core is a molded body obtained by forming a soft magnetic flat metal powder into a flat plate, the soft magnetic flat metal powder is oriented in a plane of the flat plate, and a generated magnetic flux of the coil circulates in the plane of the flat plate, and wherein the magnetic core is integrated with the laminated resin substrate so that the adhesive component is impregnated in pores of the magnetic core.

Furthermore, according to this invention, there is provided a method of manufacturing a laminated substrate embedded type inductor, comprising the steps of: placing a sheet-shaped magnetic core in a laminated resin substrate in which a pair of first resin substrates are laminated; forming via holes passing through the laminated resin substrate; and forming a coil via the via holes, wherein the laminated resin substrate contains an adhesive component, wherein the sheet-shaped magnetic core is a molded body obtained by forming a soft magnetic flat metal powder into a flat plate, the soft magnetic flat metal powder is oriented in a plane of the flat plate, and a generated magnetic flux of the coil circulates in the plane of the flat plate, and wherein the magnetic core is applied with a pressing force along with the laminated resin substrate so as to be integrated with the laminated resin substrate, thereby allowing the adhesive component to be impregnated into pores of the magnetic core.

Advantageous Effects of the Invention

According to this invention, it is configured that, using a molded magnetic core material in which a soft magnetic flat metal powder is oriented in a flat plane formed by a molded sheet, and dividing a coil into small parts, conductors forming the respective parts are deformed under pressure and joined together. In this invention, with this configuration, it is possible to provide a magnetic core and a sheet-shaped inductor, which can simultaneously achieve improvement in magnetic properties and reliability, a reduction in electric resistance, and simplification of a manufacturing method.

Further, according to this invention, it is possible to provide an inductor embedded in a laminated circuit substrate, which achieves space saving, a reduction in loss, an increase in inductance, adaptation to large-current conduction, small electric resistance, and reliability.

BRIEF DESCRIPTION OF DRAWINGS

FIG. 14A is a cross-sectional view showing a laminated substrate embedded type inductor according to a tenth embodiment of this invention and FIG. 14B is a perspective view of the laminated substrate embedded type inductor of FIG. 14A;

MODE FOR CARRYING OUT INVENTION

Hereinbelow, embodiments of this invention will be described.

Figure 1:
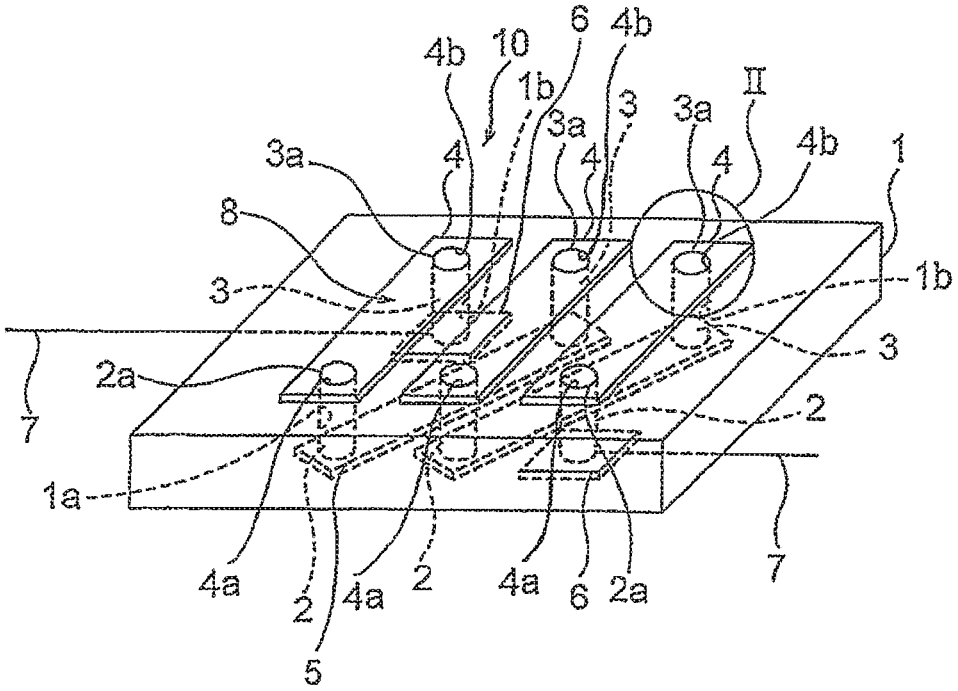
FIG. 1 is a perspective view showing a sheet-shaped inductor according to a first embodiment of this invention.
Figure 2:
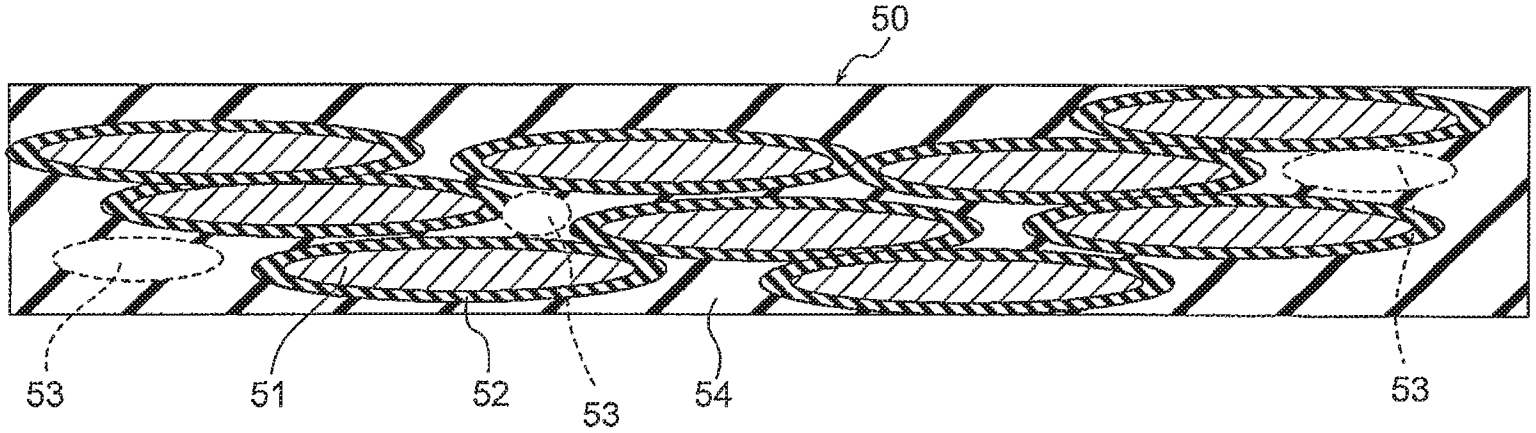
FIG. 2 is a diagram showing a molded body sheet for use as a magnetic core of the sheet-shaped inductor of FIG. 1.
Figure 3A:
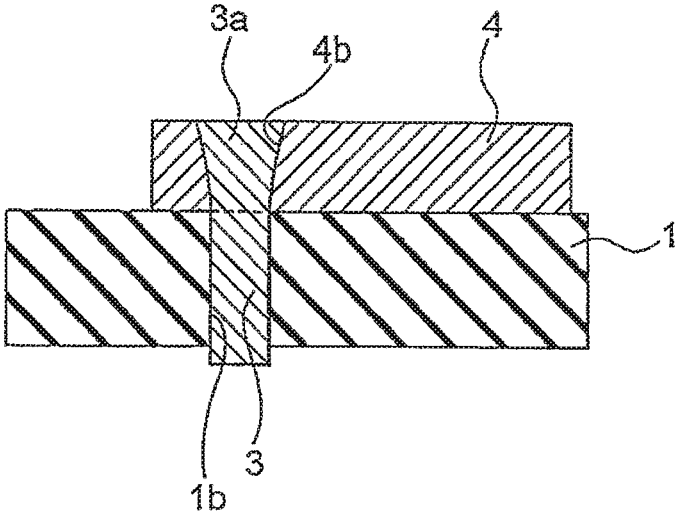
FIG. 3A is a cross-sectional view showing a plug portion denoted by II in FIG. 1.
Figure 3B:
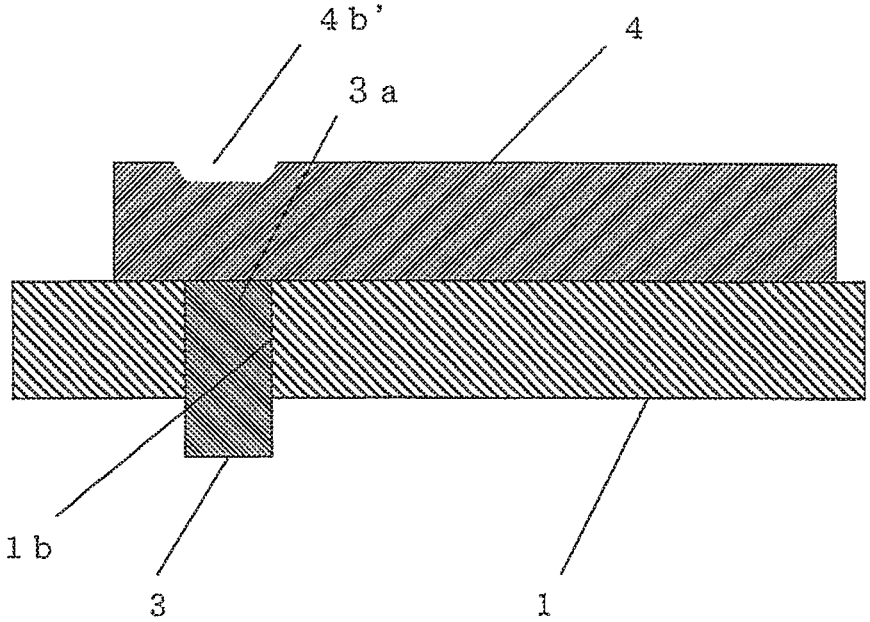
FIG. 3B is a cross-sectional view showing a portion, equivalent to the plug portion denoted by II in FIG. 1, of a sheet-shaped inductor according to another example of the first embodiment.
Figure 4:
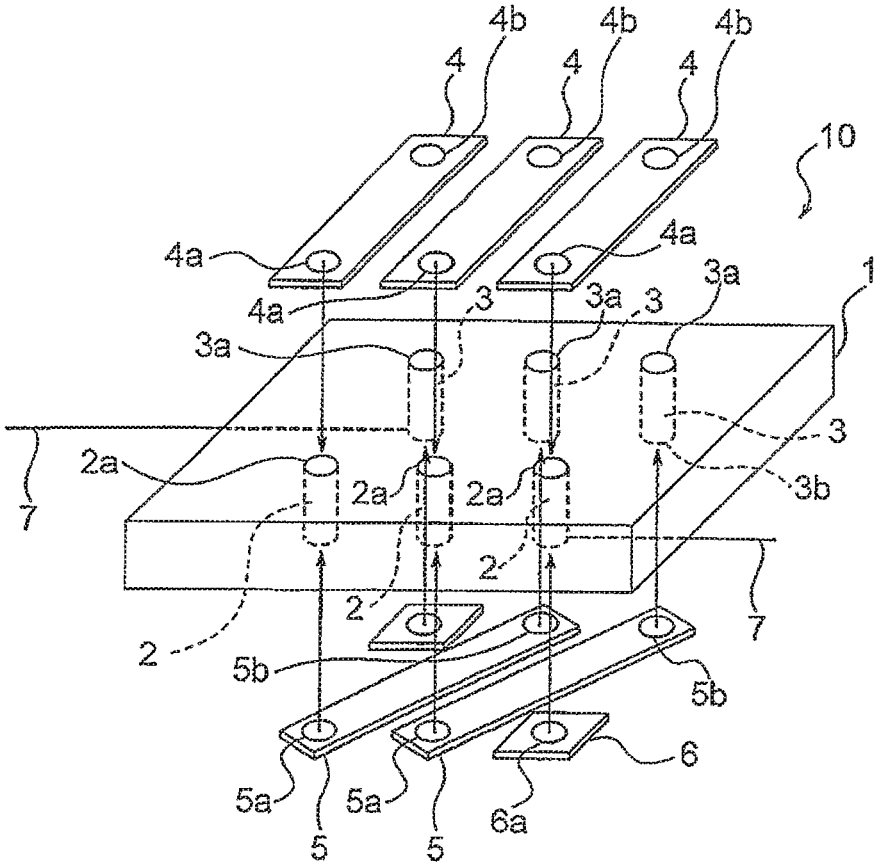
FIG. 4 is an exploded perspective view of the sheet-shaped inductor of FIG. 1.

FIG. 1 is a perspective view showing a sheet-shaped inductor according to a first embodiment of this invention. FIG. 2 is a diagram showing a molded body sheet for use as a magnetic core of the sheet-shaped inductor of FIG. 1. FIG. 3A is a cross-sectional view showing a plug portion denoted by II in FIG. 1 and FIG. 3B is a cross-sectional view showing a portion, equivalent to the plug portion denoted by II in FIG. 1, of a sheet-shaped inductor according to another example of the first embodiment. FIG. 4 is an exploded perspective view of the sheet-shaped inductor of FIG. 1.

Referring to FIG. 1, a sheet-shaped inductor 10 is formed by integrating together a sheet-shaped magnetic core 1 made of a composite magnetic material and a coil 8 by a pressing force.

The sheet-shaped inductor 10 is configured so that the magnetic flux generated when a current flows through the coil 8 circulates in the sheet plane of the magnetic core 1.

As shown in FIG. 2, a soft magnetic flat metal powder 51 and a binder 54 as a thermosetting binding resin are mixed together and then, by a slot die method, a doctor blade method, or the like, formed into a sheet in which the soft magnetic flat metal powder 51 is oriented in an in-plane direction, thereby forming a molded body sheet 50. One or a plurality of molded body sheets 50 are laminated and pressed in a lamination direction (first direction), thereby forming the magnetic core 1 as a high-density molded body. As the soft magnetic flat metal powder 51, it is possible to use an Fe—Al—Si alloy known as Sendust (registered trademark), an Fe—Ni alloy known as Permalloy (registered trademark), or an Fe-group metal or alloy (iron-based alloy), but not limited thereto. In order to improve the insulation properties of the magnetic core, an oxidation treatment may be applied to surfaces of the soft magnetic flat metal powder to form a $SiO_2$-containing insulating binding film (coating) 52 or a low melting point glass (glass frit) such as borosilicate-based glass, bismuth-based glass, phosphoric acid-based glass, or zinc oxide-based glass may be coated on surfaces of the soft magnetic flat metal powder.

In order to obtain a high magnetic permeability while having a saturation magnetic flux density, the volume ratio of the soft magnetic flat metal powder 51 to the high-density molded body (or the molded body sheet 50) is preferably 55 vol % or more. The content of the binding-resin binder 54 is preferably 10 vol % or more in order to increase the strength and 45 vol % or less in order to prevent a reduction in press-resistant strength.

Further, the porosity of pores 53 formed in the binding-resin binder 54 is 5 vol % or more in order to obtain elasticity and a moderate deformation margin and in order for an adhesive component in a binder of a substrate to be impregnated into the molded body to firmly integrate together the substrate and the molded body, and 25 vol % or less in order to increase the metal component ratio, and is more preferably 5 vol % or more and 20 vol % or less.

Since the high-density molded body of the soft magnetic flat metal powder 51 forming the magnetic core 1 has a high saturation magnetic flux density, it is possible to supply a large current, to obtain a high magnetic permeability and inductance equivalent to a ferrite, and further to obtain superimposition characteristics exceeding a ferrite. Although the powder is a metal material, since the molded body is configured such that the powder is bound by the binder 54 which is an insulator, it is excellent in frequency characteristics.

Since the magnetic core 1 composed of the high-density molded body of the soft magnetic flat metal powder 51 is not a brittle material as different from a ferrite, it is not cracked and is durable even in low-cost press molding.

Further, when the soft magnetic flat metal powder 51 is oriented in the plane so that the easy magnetization axis of the high-density molded body of the soft magnetic flat metal powder 51 of the magnetic core 1 lies in the flat plane, there is an advantage in that the magnetic permeability in the in-plane direction increases.

The coil 8 includes first and second via conductors 2 and 3, first surface conductors 4 provided on one flat surface of the magnetic core 1, and second surface conductors 5 and 6 provided on the other flat surface of the magnetic core 1. The second surface conductors 6 and 6 on both sides are respectively connected to leads 7 and 7 and used as terminals and, therefore, will be referred to as terminal members 6 and 6 in the following description.

Since the soft magnetic flat metal powder 51 is coated with the insulating binder layer 52 in the magnetic core 1, the conductors forming the coil 8 and the magnetic core 1 can be in direct contact with each other without using an insulating member.

The magnetic core 1 is provided with first via holes 1*a* passing through its two flat surfaces (front and back surfaces) facing each other in the first direction and arranged in one row at regular intervals in a second direction (length direction) crossing the first direction and is provided with second via holes 1*b* arranged in one row at regular intervals along the row of the first via holes 1*a*.

Each first via conductor 2 is composed of an elongated conductor and has a central conductor and ends 2*a* and 2*b* on both sides thereof. The first via conductor 2 is provided so as to pass through the first via hole 1*a*.

Like the first via conductor, each second via conductor 3 has a central conductor and ends 3*a* and 3*b* on both sides thereof. The second via conductor 3 is provided so as to pass through the second via hole 1*b*.

Each first surface conductor 4 has, on its both sides, plug holes 4*a* and 4*b* each formed with a plug portion. The one ends 2*a* and 3*a* of the first and second via conductors 2 and 3 provided at symmetrical positions with respect to a center line on both sides in the length direction of the magnetic core 1 are respectively press-fitted into the plug holes 4*a* and 4*b* and both ends 2*a* and 2*b*, 3*a* and 3*b* are pressed in the thickness direction (first direction) of the magnetic core along with the surface conductors 4 and 5. As a result, the one ends 2*a* and 3*a* of the first and second via conductors 2 and 3 are deformed so that, as best shown in FIGS. 3A and 3B, a tapered plug portion 3*a* (denoted by the same symbol as the one end 3*a*) having an outer cross-sectional area greater than an inner cross-sectional area is formed.

Each second surface conductor 5 has, on its both sides, plug holes 5*a* and 5*b* each formed with a plug portion. While the first and second via conductors 2 and 3 are provided at facing positions on both sides in the length direction (second direction) of the magnetic core 1, the other end 2*b* of the first via conductor 2 and the other end 3*b* of the second via conductor 3 adjacent to the other end 2*b* of the first via conductor 2 facing that first via conductor 2 in a third direction (width direction) crossing the first and second directions, i.e. the other end 3*b* of the second via conductor 3 offset by one in the length direction from the second via conductor 3 corresponding to that first via conductor 2, are fitted into the plug holes 5*b*. In other words, on the front surface side, the one end of the first via conductor 2 is connected to the one end of the second via conductor 3, facing each other in the width direction, while, on the back surface side, as different from the front surface on the one-end side, the other end 2*b* of the first via conductor 2 is connected to the other end 3*b* of the second via conductor 3 offset by one in the length direction. By pressing the other ends 2*b* and 3*b* of the first and second via conductors 2 and 3 like the one ends 2*a* and 3*a*, the other ends 2*b* and 3*b* of the first and second via conductors 2 and 3 are also deformed so that tapered plug portions 2*b* and 3*b* with a large outer cross-sectional area are formed like on the front surface side.

In FIG. 3A, upper surfaces of the plug portion 3*a* and the surface conductor are shown to protrude from the two flat surfaces of the magnetic core. However, actually, the magnetic core is plastically deformed by a pressing force so that the surface conductors are buried from the two flat surfaces. In order to bury the surface conductors from the two flat surfaces, guide grooves may be provided in advance on the two flat surfaces.

Herein, as shown in FIG. 3B, one end 3*a* of a via conductor 3 may be disposed so as to be in contact with a surface conductor 4 without providing the surface conductor 4 with a plug hole 4*b* and a pressing force may be applied to a portion, corresponding to the via conductor 3, of the surface conductor 4, thereby establishing electrical connection between the surface conductor 4 and the via conductor 3. When joining the conductors together by the pressing force, fusing or current-pulse conduction may be carried out simultaneously with the pressing or after the pressing, thereby facilitating the joining. In this event, electrical connection can be made more reliable by locally applying a pressing force to the portion, corresponding to the via conductor 3, of the surface conductor 4. By this, a recess 4*b*' is formed instead of the plug portion 3*a* at the position of the plug portion 3*a* formed in the surface conductor 4 shown in FIG. 1 and FIG. 3A and the one end 3*a* of the second via conductor serves as a plug portion 3*a*.

On the surface (back surface) side being one end side of the two surfaces facing each other in the first direction, the other end 3*b* of the second via conductor 3 on one end side in the second direction (length direction) and the other end of the first via conductor 2 on the other end side in the second direction (length direction) are respectively fitted into plug holes 6*a* and 6*a* of the terminal members 6 and 6 having the leads 7 and 7 and pressed to form plug portions 2*b* and 3*b*, like the first and second surface conductors 4 and 5, and the leads 7 and 7 are drawn out to the outside in the length direction from the respective terminal members 6 and 6. The leads 7 and 7 are integrally formed with the terminal members 6 and 6 in the example described above. However, naturally, leads 7 and 7 separate from the terminal members 6 and 6 may be attached to the terminal members 6 and 6 when or after the plug portions 2*b* and 3*b* are formed.

Herein, with respect to a DC electric resistance of the coil 8, in order to reduce a loss, the number of turns of a winding of the inductor is preferably small while the cross-sectional area thereof is preferably large. Preferably, the coil 8 has a wire diameter equivalent to a round wire having a diameter of 0.15 mm or more, which is difficult to achieve by a printed conductor or plating. From the following formula 1, a cross-sectional area S of a coil is preferably such that a calorific value is 1 W or less when 15 A flows through a lead having a length of 2 cm.

$$RI^2=(2\text{ cm/S})(1.69\ \mu\Omega\text{cm})\cdot(15)^2\leq 1\text{ W} \qquad \text{[Formula 1]}$$

The via conductor preferably has a cross-sectional area equivalent to a round wire having a diameter of 0.4 mm or more and more preferably a diameter of 0.8 to 1.2 mm.

The first and second surface conductors 4 and 5 each preferably have a cross-sectional area equivalent to a rectangle having a width of 2 mm and a thickness of 0.25 mm, or more, and more preferably a width of 2 mm and a thickness of 0.3 mm.

In the first embodiment of this invention, since the magnetic core 1 is composed of the high-density molded body, no crack occurs when joining the conductors together under pressure.

The via holes are provided in the high-density molded body, then the conductors provided in the via holes and the conductors having the plug portions for connection between the vias are disposed along with the molded body, and then the via portions are pressed. The via conductors 2 and 3 provided in the vias are fitted into the plug holes of the surface conductors and deformed by the pressing force to form the plug portions so that the highly reliable coil is formed.

In the coil according to the first embodiment of this invention, the winding can be simple and can be thickened and, therefore, the electric resistance can be made small and the reliability of the joined portions is improved.

Figure 5:
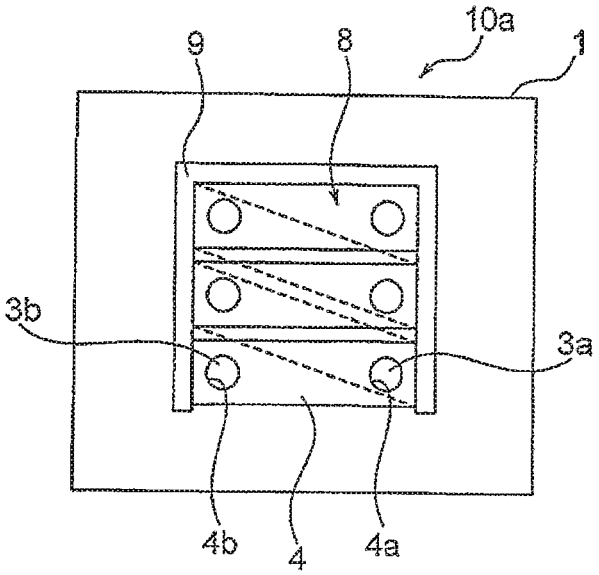
FIG. 5 is a plan view showing a sheet-shaped inductor according to a second embodiment of this invention.

FIG. 5 is a plan view showing a sheet-shaped inductor according to a second embodiment of this invention. A sheet-shaped inductor 10*a* according to the second embodiment of this invention shown in FIG. 5 has the same structure as the sheet-shaped inductor 10 according to the first embodiment shown in FIGS. 1 to 4 except that a Π-shaped gap 9 is provided around surface conductors 4 forming one surface side of a coil 8 so as to pass through two surfaces (front and back surfaces) facing each other in the first direction. The sheet-shaped inductor 10*a* according to the second embodiment of this invention is configured so that the magnetic flux generated when a current flows through the coil 8 circulates in the sheet plane of a magnetic core 1.

When a pressing force is applied for connection, a ferrite magnetic core is brittle and cracked. In particular, when a slit or the like for property adjustment is provided at a part of a sheet-shaped inductor, this tendency is particularly significant. According to the second embodiment of this invention, a molded body of a flat metal powder is used as the magnetic core 1 and therefore this difficult point is solved.

Since the sheet-shaped inductor according to the second embodiment of this invention is a compact molded body of a metal magnetic powder, it has an advantage in that it is excellent in frequency characteristics, that it is excellent in superimposition characteristics, and that it is not cracked when joining conductors together under pressure.

Figure 6:
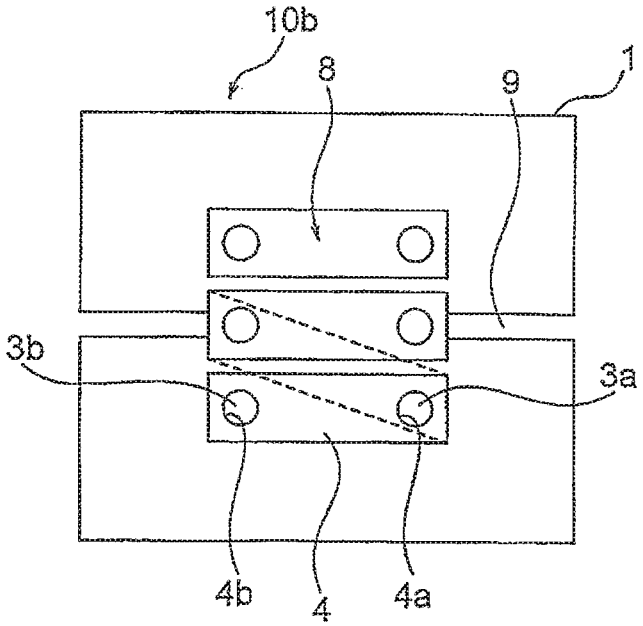
FIG. 6 is a plan view showing a sheet-shaped inductor according to a third embodiment of this invention.

FIG. 6 is a plan view showing a sheet-shaped inductor according to a third embodiment of this invention. A sheet-shaped inductor 10*b* according to the third embodiment of this invention shown in FIG. 6 has the same structure as the sheet-shaped inductor according to the first embodiment of this invention shown in FIGS. 1 to 4 except that a gap 9 is provided so as to pass through two flat surfaces of a magnetic core 1 in the first direction (thickness direction) and to extend in the third direction to divide the magnetic core 1 into two parts.

In the sheet-shaped inductor 10*b* according to the third embodiment of this invention, like in the sheet-shaped inductors 10 and 10*a* according to the first and second embodiments, since the magnetic core 1 is a compact molded body of a soft magnetic flat metal powder, it has an advantage in that it is excellent in frequency characteristics, that it is excellent in superimposition characteristics, and that it is not cracked when joining conductors together under pressure.

Figure 7:
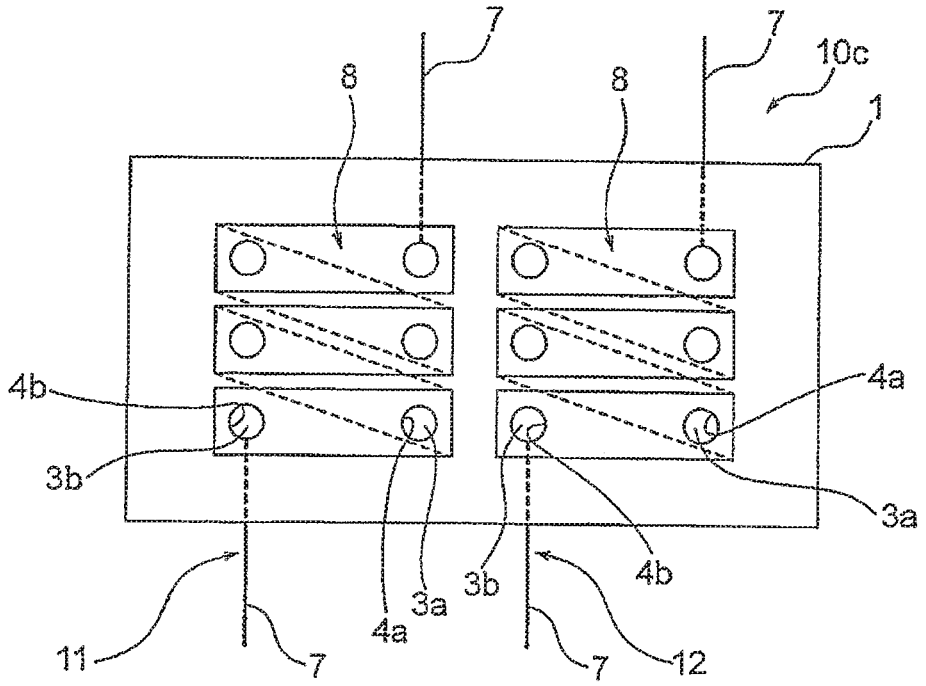
FIG. 7 is a plan view showing a sheet-shaped inductor according to a fourth embodiment of this invention.

FIG. 7 is a plan view showing a sheet-shaped inductor according to a fourth embodiment of this invention. A sheet-shaped inductor 10*c* according to the fourth embodiment of this invention shown in FIG. 7 has the same structure as the sheet-shaped inductor 10 according to the first embodiment except that coils 8 each having the same shape as the coil of the sheet-shaped inductor 10 shown in FIGS. 1 to 4 are disposed side by side in the width direction.

In the sheet-shaped inductor 10*c* of FIG. 7, one of the coils 8 serves as a primary coil and the other coil 8 serves as a secondary coil.

In the sheet-shaped inductor 10*c* according to the fourth embodiment of this invention, like in the sheet-shaped inductors 10, 10*a*, and 10*b* according to the first to third embodiments, since a magnetic core 1 is a compact molded body of a soft magnetic flat metal powder, it has an advantage in that it is excellent in frequency characteristics, that it is excellent in superimposition characteristics, and that it is not cracked when joining conductors together under pressure.

Figure 8:
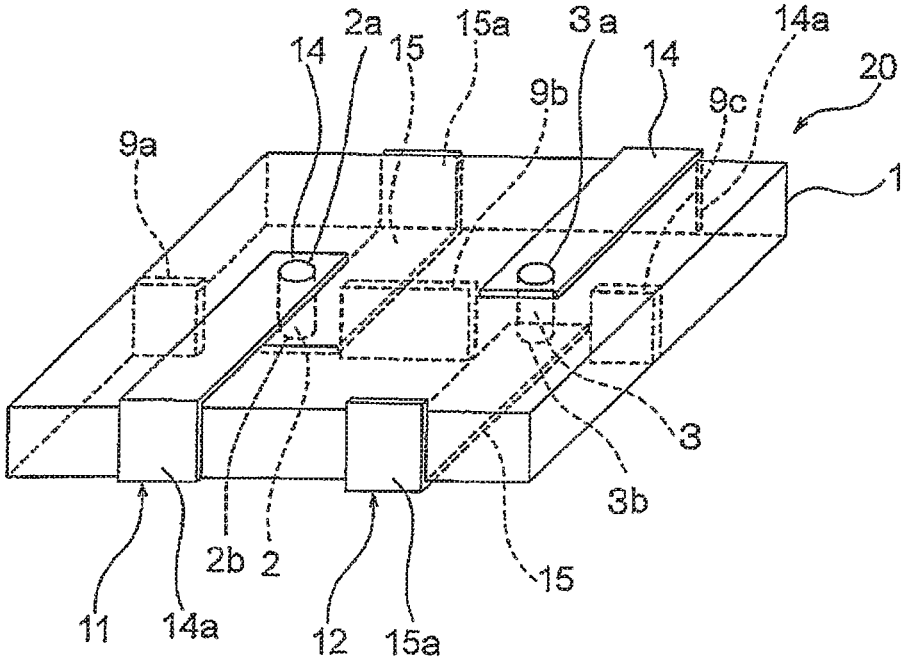
FIG. 8 is a perspective view showing a sheet-shaped inductor according to a fifth embodiment of this invention.

FIG. 8 is a perspective view showing a sheet-shaped inductor according to a fifth embodiment of this invention.

Referring to FIG. 8, a sheet-shaped inductor 20 includes a primary coil 11 and a secondary coil 12. The primary coil 11 includes a first via conductor 2 and first and second surface conductors 14 and 15 respectively connected, for terminal connection, to both ends 2*a* and 2*b* of the first via conductor. The first and second surface conductors 14 and 15 extend to their respective side surfaces of a magnetic core 1 and form first and second side surface electrodes 14*a* and 15*a* on the side surfaces of the magnetic core 1. The secondary coil 12 includes first and second surface conductors 14 and 15 connected to both ends 3*a* and 3*b* of a second via conductor 3. The first and second surface conductors 14 and 15 extend to both side surfaces of the magnetic core 1 and form side surface electrodes 14*a* and 15*a* on the side surfaces of the magnetic core 1.

Upper surfaces of the first and second surface conductors 14 and 15 and upper surfaces of the plug portions 2*a*, 2*b*, 3*a*, and 3*b* are located inward of two flat surfaces of the magnetic core 1, i.e. buried, upon pressing. However, naturally, guide grooves for burying the first and second surface conductors 14 and 15 may be provided in advance on the two flat surfaces of the magnetic core 1.

Further, gaps 9*a*, 9*b*, and 9*c* passing through the two surfaces facing each other along the first direction are respectively provided between the primary coil 11 and the secondary coil 12, between one end side of the magnetic core 1 and the primary coil 11, and between the other end of the magnetic core 1 and the secondary coil 12 in the second direction (length direction) of the magnetic core 1.

As described above, in the first to fifth embodiments of this invention, the first and second via conductors 2 and 3 are fitted to the first and second surface conductors 4 and 5, 14 and 15 and both sides of the first and second via conductors 2 and 3 are deformed by pressing to form the plug portions so that the conductors are joined together via the plug portions. Therefore, mechanical joining between the first and second surface conductors 4 and 5, 14 and 15 and the first and second via conductors 2 and 3 is made possible, which is difficult in the case of a ferrite magnetic core or the like due to crack of the magnetic core.

A metal magnetic core has an advantage in that it is not easily magnetically saturated compared to a ferrite magnetic core and thus allows a large current to flow, while the metal magnetic core has a drawback in that excitation is difficult due to eddy current loss. On the other hand, according to the magnetic cores 1 of the first to fifth embodiments of this invention, use is made of the molded sheet which is the powder molded body with no eddy current loss by coating the metal powder with the insulating binder component and further the soft magnetic flat metal powder is oriented in the flat plane, and therefore, it is possible to prevent a reduction in magnetic permeability and to provide the magnetic gap.

According to the sheet-shaped inductors of the first to fifth embodiments of this invention, the sheet-shaped inductor having two or more kinds of coils may, of course, be a sheet-shaped inductor that functions as a transformer or a coupled inductor by electromagnetic coupling between the two or more kinds of coils.

Further, sixth to tenth embodiments of this invention will be described with reference to the drawings.

Figure 9A:
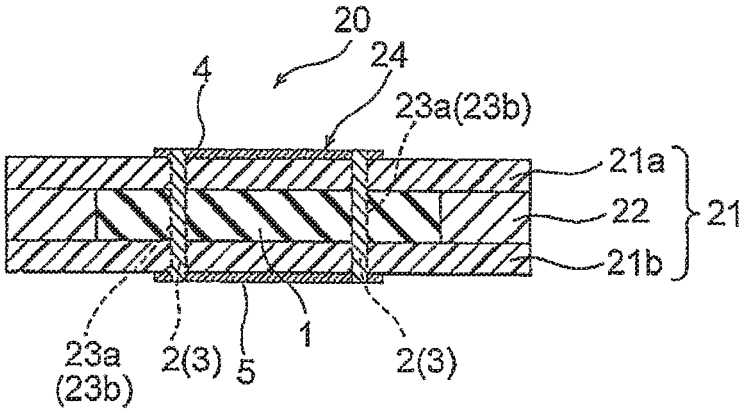
FIG. 9A is a cross-sectional view showing a laminated substrate embedded type inductor according to a sixth embodiment of this invention and FIG. 9B is a perspective view of the inductor of FIG. 9A.
Figure 9B:
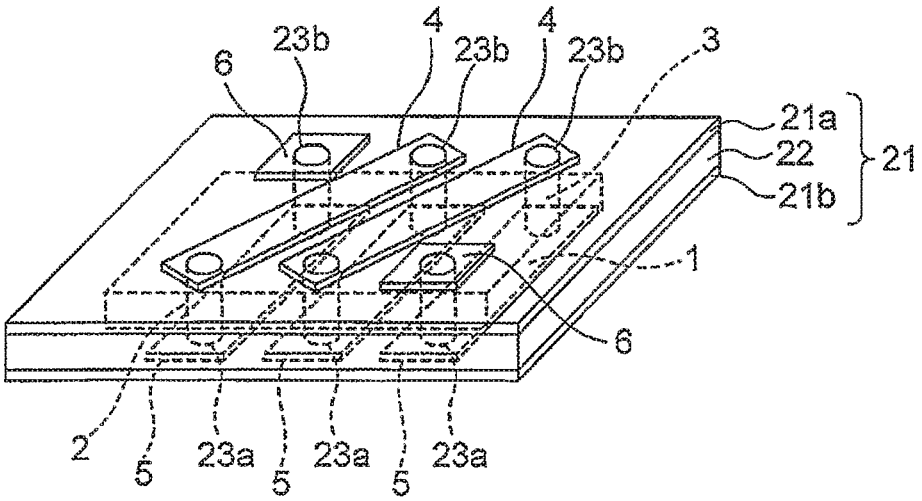

FIG. 9A is a cross-sectional view showing a laminated substrate embedded type inductor according to a sixth embodiment of this invention and FIG. 9B is a perspective view of the inductor of FIG. 9A.

Referring to FIG. 9A and FIG. 9B, a laminated substrate embedded type inductor 20 according to the embodiment of this invention includes a laminated resin substrate 21 in which a pair of first resin substrates 21*a* and 21 *b* are laminated, a magnetic core 1 composed of a magnetic body and enclosed in the laminated resin substrate 21, first and second via holes 23*a* and 23*b* provided so as to pass through the laminated resin substrate 21 and the magnetic core 1, and a coil 24 formed via the first and second via holes 23*a* and 23*b*.

The first resin substrates 21*a* and 21 *b* are each formed by a single-sided copper foil substrate having a copper foil on its one surface. The first resin substrates 21*a* and 21*b* respectively have first substrate surface conductors 4 and second substrate surface conductors 5 (hereinafter simply referred to as first and second surface conductors 4 and 5), and first and second surface conductors (terminal members) 6 and 6 for terminal connection, which are formed by patterning the copper foils.

The thickness of the first and second surface conductors 4 and 5 is attained by laminating two or more layers of conductor films each having a thickness of 100 μm or less. Herein, in terms of the thickness of the first and second surface conductors 4 and 5, each of them is preferably formed by using at least two or more layers of copper foil patterns each having a thickness of 100 μm or less. This is because since the skin depth δ is about 70 μm at 1 MHz and about 50 μm at 2 MHz, the thickness of a copper foil forming a coil conductor is desirably 70×2=140 μm or less in terms of reducing the AC electric resistance at 1 MHz or more, while, it is desirable to simultaneously reduce the DC electric resistance by increasing the total cross-sectional area of a coil conductor as much as possible, and therefore, the total coil conductor cross-sectional area is increased by using two or more layers of copper foil patterns each of 100 μm or less forming the conductor of the coil 24.

The coil 24 includes first via conductors 2 provided so as to pass through the first via holes 23*a*, second via conductors 3 provided so as to pass through the second via holes 23*b*, and the first and second surface conductors 4 and 5 respectively connected to ends of the first and second via conductors 2 and 3.

A conductive paste or a copper wire can be used as the first and second via conductors 2 and 3. However, any material may be used as long as it has conductivity for filling the first and second via holes 23*a* and 23*b*.

Although not shown in FIG. 9A and FIG. 9B, in the sixth embodiment, when copper wires are used as the first and second via conductors 2 and 3, the first and second via conductors 2 and 3 are fixedly connected to the first and second surface conductors 4 and 5 by soldering. However, like in the first and fifth embodiments, plug portions 2*a*, 2*b*, 3*a*, and 3*b* may, of course, be respectively formed at ends of the via conductors 2 and 3 in the surface conductors 4, 5, and 6.

The laminated resin substrate 21 has a prepreg 22 containing an adhesive component.

The magnetic core 1 composed of the magnetic body is a sheet-shaped molded body obtained by laminating a plurality of magnetic bodies each obtained by forming a soft magnetic flat metal powder into a sheet, and press-molding the magnetic bodies into a flat plate shape. This soft magnetic flat metal powder is oriented so as to have an easy magnetization axis in the plane of the flat plate. Herein, when the easy magnetization axis, i.e. the flat powder, is oriented in the plane, there is an advantage in that the magnetic permeability in the in-plane direction increases.

By carrying out the press molding as described above, even if a pressing force is applied to the molded body, no crack of the molded body occurs and further its magnetic properties do not change, and therefore, the molded body can be easily enclosed in the laminated substrate.

The magnetic core 1 composed of the magnetic body is applied with a pressing force along with the laminated resin substrate and is integrated with the laminated resin substrate. The adhesive component is impregnated in pores of the magnetic core 1.

Further, the magnetic flux generated when a current flows through the coil 24 circulates in the sheet plane of the flat plate.

Herein, the porosity of the molded body forming the magnetic core 1 is 5 vol % or more in order to obtain both elasticity and a moderate deformation margin and in order to allow the adhesive component of the base member (prepreg 22) of the laminated resin substrate to be impregnated into the molded body to firmly integrate together the substrate and the molded body, and 25 vol % or less in order to increase the metal component ratio, and is more preferably 5 vol % or more and 20 vol % or less.

The molded body forming the magnetic core 1 contains a soft magnetic flat metal powder and a binder binding the soft magnetic flat metal powder. The volume ratio of the binder component is 10 vol % or more and 45 vol % or less, and more preferably 10 vol % or more and 20 vol % or less. This is because if the volume ratio of the binder component is less than 10 vol %, the strength becomes insufficient, while, if it is greater than 45 vol %, the metal component ratio becomes small and the press-resistant strength becomes insufficient.

Although the magnetic powder contained in the magnetic core 1 is a metal material, since the molded body is configured such that the soft magnetic flat metal powder is bound by the insulator, it is excellent in frequency characteristics and it is not a brittle material as different from a ferrite being an oxide magnetic material and thus is durable in press molding.

The molded body is preferably a high-density molded body in which the volume ratio of the soft magnetic flat metal powder to the molded body is 55 vol % or more. This is because since the molded body contains the 55 vol % or more soft magnetic metal component, a high magnetic permeability equivalent to a ferrite is obtained while having a high saturation magnetic flux density. It is more preferable to increase the volume ratio of the metal component in the molded body to 65 vol % or more.

Figure 10A:
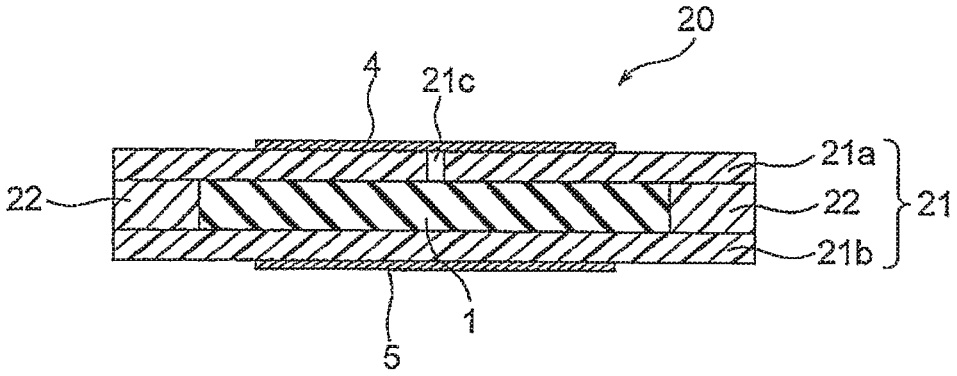
FIGS. 10A, 10B and 10C are cross-sectional views sequentially showing manufacturing processes of the inductor according to the sixth embodiment of FIG. 9A and FIG. 9B.
Figure 10B:
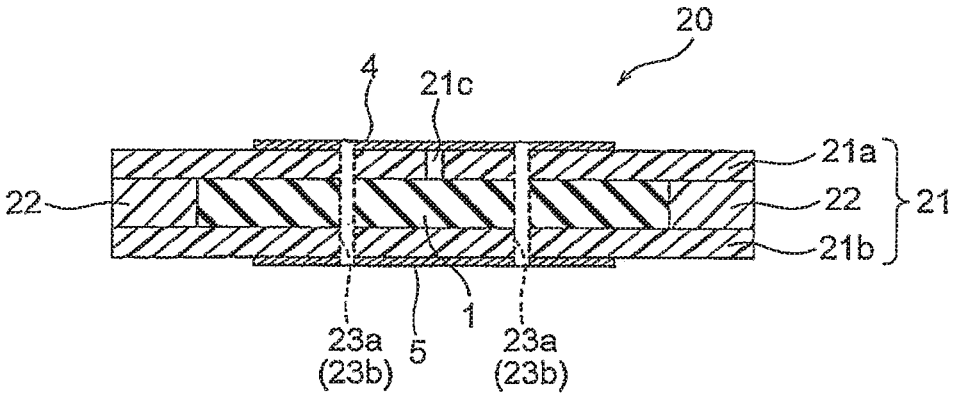
Figure 10C:
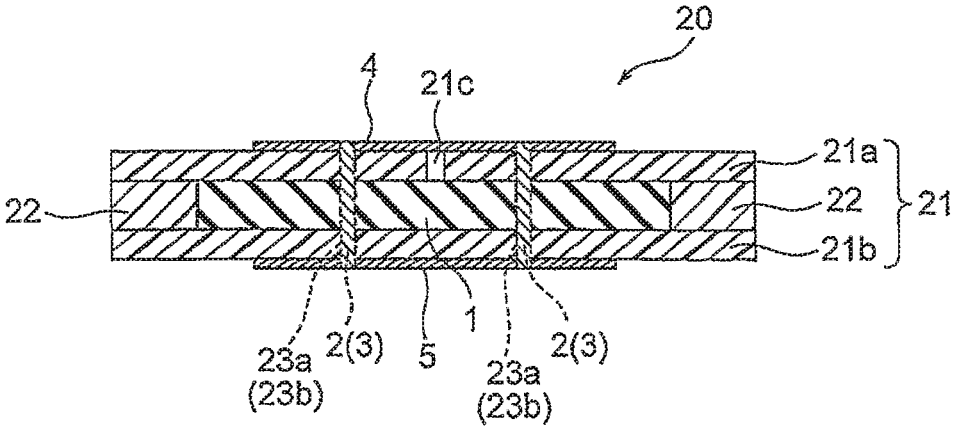

FIG. 10A, FIG. 10B, and FIG. 100 are cross-sectional views sequentially showing manufacturing processes of the laminated substrate embedded type inductor according to the sixth embodiment of FIG. 9A and FIG. 9B. Referring to FIG. 10A, the magnetic core 1 is placed in the prepreg 22 and then sandwiched from the upper and lower sides by the first resin substrates 21*a* and 21*b* each formed by the single-sided copper foil substrate having the patterned conductor pattern on its one surface, and then hot pressing is applied thereto from both surfaces. Symbol 21*c* denotes an air vent hole for interlayer adhesion hot pressing provided in the first resin substrate 21*a*.

Further, after the hot pressing, as shown in FIG. 10B, the first and second via holes 23*a* and 23*b* for forming the first and second via conductors 2 and 3 are formed so as to pass through the first and second surface conductors 4 and 5.

Then, as shown in FIG. 100, the first and second via conductors 2 and 3 each in the form of a conductive paste or a copper wire are passed through the first and second via holes 23*a* and 23*b* and then pressing is applied to both surfaces, thereby obtaining the laminated substrate embedded type inductor 20.

Figure 11:
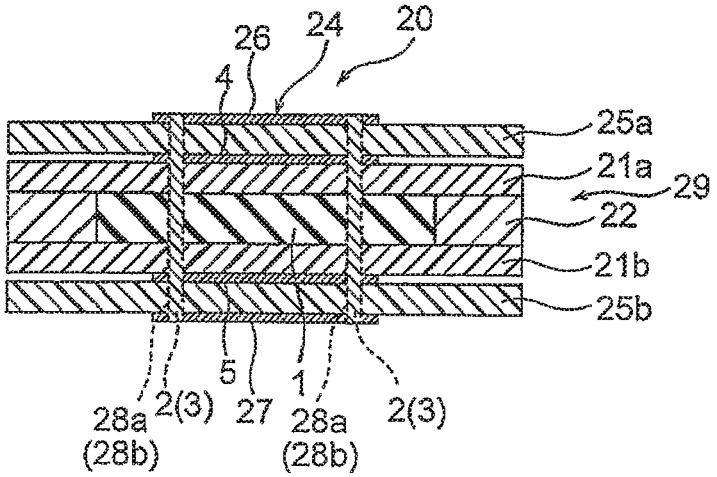
FIG. 11 is a cross-sectional view showing a laminated substrate embedded type inductor according to a seventh embodiment of this invention.

FIG. 11 is a cross-sectional view showing a laminated substrate embedded type inductor according to a seventh embodiment of this invention. Referring to FIG. 11, a laminated substrate embedded type inductor 20 according to the thirteenth embodiment of this invention differs as a laminated substrate in that it further has second resin substrates 25*a* and 25*b* laminated on a pair of first resin substrates 21*a* and 21*b* and that it further has third and fourth surface conductors 26 and 27 on surfaces of the second resin substrates 25*a* and 25*b*.

Specifically, the laminated substrate embedded type inductor 20 includes a laminated resin substrate 29 having the pair of first resin substrates 21*a* and 21*b* and the pair of second resin substrates 25*a* and 25*b* laminated thereon, a magnetic core 1 composed of a magnetic body and enclosed in the laminated resin substrate 29, first and second via holes 28*a* and 28*b* provided so as to pass through the laminated resin substrate 29 and the magnetic core 1, and a coil 24 formed via the first and second via holes 28*a* and 28*b*.

The first resin substrates 21*a* and 21 *b* are each formed by an insulating resin substrate. The second resin substrates 25*a* and 25*b* are each formed by a double-sided copper foil substrate having copper foils on its both surfaces. The second resin substrates 25*a* and 25*b* respectively have first surface conductors 4 corresponding to the first substrate surface conductors 4, second surface conductors 5 corresponding to the second substrate surface conductors 5, the third substrate surface conductors 26, and the fourth substrate surface conductors 27 (hereinafter simply referred to as the third and fourth surface conductors), which are formed by patterning the copper foils. Like the first and second surface conductors 4 and 5 of the sixth embodiment described above, the thickness of the first and second surface conductors 4 and 5 is attained by laminating two or more layers of conductor films each of 100 μm or less.

Like the first and second surface conductors 4 and 5, the thickness of the third and fourth surface conductors 26 and 27 is attained by using at least two or more layers of copper foil patterns each having a thickness of 100 μm or less. The skin depth δ is about 70 μm at 1 MHz and about 50 μm at 2 MHz, the thickness of a copper foil forming a coil conductor is desirably 70×2=140 μm or less in terms of reducing the AC electric resistance at 1 MHz or more. However, it is desirable to simultaneously reduce the DC electric resistance by increasing the total cross-sectional area of a coil conductor as much as possible. Therefore, the total coil conductor cross-sectional area is increased by using two or more layers of copper foil patterns each of 100 μm or less forming the coil conductor.

The coil 24 includes first and second via conductors 2 and 3 provided so as to pass through the first and second via holes 28*a* and 28*b*, and the first and second surface conductors 4 and 5 and the third and fourth surface conductors 26 and 27 respectively connected to end portions of the first and second via conductors 2 and 3.

The laminated resin substrate 29 has a prepreg 22 containing an adhesive component.

Since the magnetic core 1 is the same as that described using FIG. 9A and FIG. 9B and FIG. 10A and FIG. 10B, a description thereof is omitted.

Figure 12:
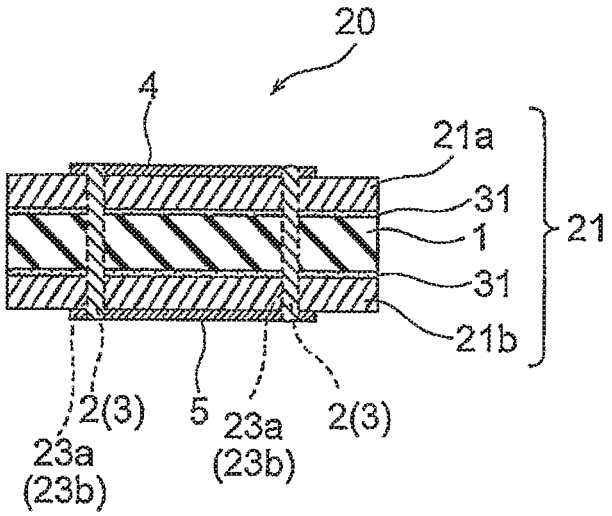
FIG. 12 is a cross-sectional view showing a laminated substrate embedded type inductor according to an eighth embodiment of this invention.

FIG. 12 is a cross-sectional view showing a laminated substrate embedded type inductor according to an eighth embodiment of this invention.

Referring to FIG. 12, an inductor 20 according to the fourteenth embodiment of this invention includes a laminated resin substrate 21 in which a pair of first resin substrates 21*a* and 21*b* are laminated, a sheet-shaped magnetic core 1 sandwiched and placed in the laminated resin substrate 21, via holes 23*a* and 23*b* provided so as to pass through the laminated resin substrate 21 and the magnetic core 1, and a coil 24 formed via the via holes 23*a* and 23*b*.

The first resin substrates 21*a* and 21 *b* are each formed by a single-sided copper foil substrate having a copper foil on its one surface and respectively have first surface conductors 4 and second surface conductors 5 which are formed by patterning the copper foils.

As described in the sixth and seventh embodiments, the thickness of the first and second surface conductors 4 and 5 is attained by laminating two or more layers of conductor films each of 100 μm or less.

The coil 24 includes first via conductors 2 provided so as to pass through the first via holes 23*a*, second via conductors 3 provided so as to pass through the second via holes 23*b*, and the first and second surface conductors 4 and 5 respectively connected to ends of the first and second via conductors 2 and 3.

A conductive material such as a conductive paste or a copper wire can be used as the first and second via conductors 2 and 3. The first and second via conductors 2 and 3 are fixedly joined to the surface conductors by soldering like in the sixth embodiment. However, when a plastically deformable conductive material such as a copper wire is used, plug portions 2*a*, 2*b*, 3*a*, and 3*b* may, of course, be respectively formed at ends of the via conductors 2 and 3 in the surface conductors 4, 5, and 6 (not illustrated) like in the first and fifth embodiments.

The laminated resin substrate 21 has adhesive layers 31 containing an adhesive component and formed on inner surfaces of the first and second resin substrates 21*a* and 21 *b*.

The magnetic core 1 is a molded body obtained by molding a soft magnetic flat metal powder into a flat plate. The easy magnetization axis of this soft magnetic flat metal powder is oriented in the plane of the flat plate. When such a soft magnetic flat metal powder is oriented in the plane, there is an advantage in that the magnetic permeability in the in-plane direction increases. Further, in this invention, the press molding is used when placing the magnetic core 1 into the laminated substrate. By carrying out the press molding, even if a pressing force is applied to the molded body, no crack of the molded body occurs and further its magnetic properties do not change, and therefore, the molded body can be easily enclosed in the substrate.

The magnetic flux generated when the coil 24 is energized circulates in the plane of the flat plate of the magnetic core 1. The magnetic core 1 is applied with a pressing force along with the laminated resin substrate and is integrated with the laminated resin substrate. The adhesive component from the adhesive layers 31 of the first resin substrates 21*a* and 21 *b* is impregnated in pores of the magnetic core 1.

Herein, the porosity of the molded body forming the magnetic core 1 is 5 vol % or more and 25 vol % or less, preferably 5 vol % or more and 20 vol % or less. This is because since the molded body has 5 vol % or more pores, the molded body has both elasticity and a moderate deformation margin, because the molded body has 5 vol % or more pores so that the adhesive component of the resin substrate is impregnated into the pores, because the adhesive component is not impregnated if the porosity is less than 5 vol %, and because if the porosity is greater than 25 vol %, the metal component ratio becomes high and the metal filling ratio and the strength become insufficient.

This molded body contains a soft magnetic flat metal powder and a binder binding the soft magnetic flat metal powder. The volume ratio of the binder component is 10 vol % or more and 45 vol % or less, and more preferably 10 vol % or more and 20 vol % or less. This is because if it is less than 10 vol %, the strength unfavorably becomes insufficient, while, if it is greater than 45 vol %, the metal component ratio becomes small and the press-resistant strength becomes insufficient.

Although the powder is a metal material, since the molded body is configured such that the powder is bound by the insulator, it is excellent in frequency characteristics and it is not a brittle material as different from a ferrite and thus is durable in press molding.

The volume ratio of the soft magnetic flat metal powder to the molded body is preferably 55 vol % or more. This is because, in order to obtain a high-density molded body of the soft magnetic flat metal powder, the molded body contains the 55 vol % or more soft magnetic metal component and therefore a high magnetic permeability equivalent to a ferrite is obtained while having a high saturation magnetic flux density. It is more preferable to increase the volume ratio of the metal component in the molded body to 65 vol % or more.

Figure 13:
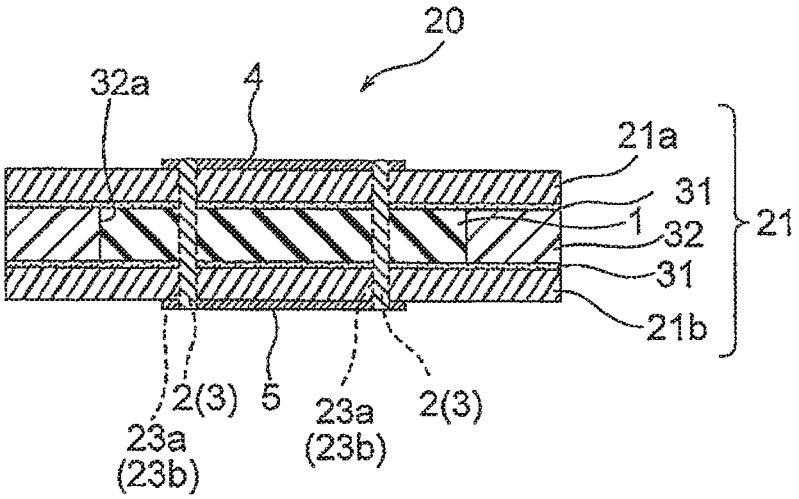
FIG. 13 is a cross-sectional view showing a laminated substrate embedded type inductor according to a ninth embodiment of this invention.

FIG. 13 is a cross-sectional view showing a laminated substrate embedded type inductor according to a ninth embodiment of this invention. Referring to FIG. 13, a laminated substrate embedded type inductor 20 according to the ninth embodiment of this invention includes a laminated resin substrate 21 in which a pair of first resin substrates 21*a* and 21*b* and a third resin substrate 32 having a receiving portion 32*a* for receiving therein a magnetic core 1 are laminated, the magnetic core 1 enclosed in the laminated resin substrate 21, via holes 23*a* and 23*b* provided so as to pass through the laminated resin substrate 21 and the magnetic core 1, and a coil 24 formed via the via holes 23*a* and 23*b*.

The first resin substrates 21*a* and 21 *b* each include an insulating resin substrate having an adhesive layer 31 on its inner surface.

The third resin substrate 32 serves as a spacer and has adhesive layers 31 on its both front and back surfaces and on inner surfaces of the receiving portion 32*a*.

First and second surface conductors 4 and 5 each made of a copper foil or a copper plate are formed on surfaces of the first resin substrates 21*a* and 21 *b*. Like in the sixth to eighth embodiments, the thickness of the first and second surface conductors 4 and 5 is attained by laminating two or more layers of conductor films each of 100 μm or less. Herein, as described earlier, the thickness of the surface conductors 4 and 5 is attained by using at least two or more layers of copper foil patterns each having a thickness of 100 μm or less. The skin depth δ is about 70 μm at 1 MHz and about 50 μm at 2 MHz, the thickness of a copper foil forming a coil conductor is desirably 70×2=140 μm or less in terms of reducing the AC electric resistance at 1 MHz or more.

However, it is desirable to simultaneously reduce the DC electric resistance by increasing the total cross-sectional area of a coil conductor as much as possible. Therefore, the total coil conductor cross-sectional area is increased by using two or more layers of copper foil patterns each of 100 μm or less forming the coil conductor.

The coil 24 includes via conductors 2 and 3 provided so as to pass through the via holes 23*a* and 23*b*, and the first and second surface conductors 4 and 5 respectively connected to ends of the via conductors 2 and 3.

A conductive material such as a conductive paste or a copper wire can be used as the via conductors 2 and 3. The via conductors 2 and 3 are fixedly joined to the first and second surface conductors by soldering. However, when a plastically deformable conductive material such as a copper wire is used, plug portions 2*a*, 2*b*, 3*a*, and 3*b* may, of course, be respectively formed at ends of the first and second via conductors 2 and 3 in the surface conductors 4, 5, and 6 (not illustrated) like in the first and fifth embodiments.

The first resin substrates 21*a* and 21 *b* of the laminated resin substrate 21 have on their inner surfaces the adhesive layers 31 and 31 containing an adhesive component. The third resin substrate 32 has the adhesive layers on its both surfaces and on the inner surfaces of the receiving portion 32*a*.

The magnetic core 1 composed of a magnetic body is a molded body obtained by forming a soft magnetic flat metal powder into a sheet, then laminating a plurality of such sheets, and then molding them into a flat plate. This soft magnetic flat metal powder is oriented in the plane of the flat plate.

In this invention, when the easy magnetization axis, i.e. the flat powder, is oriented in the plane, there is an advantage in that the magnetic permeability in the in-plane direction increases.

Using the press molding for manufacturing the magnetic core 1, there is an advantage in that even if a pressing force is applied to the molded body, no crack of the molded body occurs and further its magnetic properties do not change, and therefore, the molded body can be easily enclosed in the substrate.

The magnetic flux generated when the coil 24 is energized circulates in the plane of the flat plate of the magnetic core 1. The magnetic core 1 is applied with a pressing force along with the laminated resin substrate and is integrated with the laminated resin substrate. The adhesive component is impregnated in pores of the magnetic core 1.

Herein, the porosity of the molded body forming the magnetic core 1 is preferably 5 vol % or more at which the adhesive component of the adhesive layers can be impregnated into the molded body to firmly integrate together the substrate and the molded body to provide both elasticity and a moderate deformation margin, while, it is preferably 25 vol % or less at which the metal filling ratio and the strength do not become insufficient. The adhesive component is not impregnated if the porosity is less than 5 vol %.

The molded body contains a soft magnetic flat metal powder and a binder binding the soft magnetic flat metal powder. The volume ratio of the binder component is preferably 10 vol % or more and 45 vol % or less, and more preferably 10 vol % or more and 20 vol % or less. This is because if it is less than 10 vol %, the strength becomes insufficient, while, if it is greater than 45 vol %, the press-resistant strength becomes insufficient (the metal component ratio becomes high).

Although the powder is a metal material, since the molded body is configured such that the powder is bound by the insulator, it is excellent in frequency characteristics and it is not a brittle material as different from a ferrite and thus is durable in press molding.

The volume ratio of the soft magnetic flat metal powder to the molded body is preferably 55 vol % or more. This is because since the molded body contains the 55 vol % or more soft magnetic metal component, a high magnetic permeability equivalent to a ferrite is obtained while having a high saturation magnetic flux density. Further, by setting the volume ratio of the metal component to 65 vol % or more, the metal component ratio can be made high.

FIG. 14A is a cross-sectional view showing a laminated substrate embedded type inductor according to a tenth embodiment of this invention and FIG. 14B is a perspective view of the laminated substrate embedded type inductor of FIG. 14A.

Referring to FIG. 14A and FIG. 14B, a laminated substrate embedded type inductor 20 according to the tenth embodiment includes a laminated resin substrate 30 in which a pair of first resin substrates 21*a* and 21*b* and a third resin substrate 32 having a □-shaped receiving portion 32*a* for receiving therein a magnetic core 1 composed of a magnetic body are laminated, the □-shaped magnetic core 1 composed of the magnetic body and enclosed in the laminated resin substrate 30, first and second via holes 23*a* and 23*b* provided so as to pass through the laminated resin substrate 30 at portions around the magnetic core 1, and a primary coil 24*a* and a secondary coil 24*b* each formed via the first and second via holes 23*a* and 23*b*.

The first resin substrates 21*a* and 21 *b* each include an insulating resin substrate having an adhesive layer 31 on its inner surface.

The third resin substrate 32 serves as a spacer and has adhesive layers 31 on its both surfaces and on inner surfaces of the receiving portion 32*a*.

First and second surface conductors 4 and 5 each made of a copper foil or a copper plate are formed on surfaces of the first resin substrates 21*a* and 21 *b*. Each of the first and second surface conductors 4 and 5 is formed to cross opposite sides of the □-shaped magnetic core 1.

Like in the sixth to ninth embodiments, the thickness of the first and second surface conductors 4 and 5 is attained by laminating two or more layers of conductor films each of 100 μm or less. Herein, as described earlier, the thickness of each surface conductor is attained by using at least two or more layers of copper foil patterns each having a thickness of 100 μm or less. The skin depth δ is about 70 μm at 1 MHz and about 50 μm at 2 MHz, the thickness of a copper foil forming a coil conductor is desirably 70×2=140 μm or less in terms of reducing the AC electric resistance at 1 MHz or more. However, it is desirable to simultaneously reduce the DC electric resistance by increasing the total cross-sectional area of a coil conductor as much as possible. Therefore, the total coil conductor cross-sectional area is increased by using two or more layers of copper foil patterns each of 100 μm or less forming the coil conductor.

The primary coil 24*a* and the secondary coil 24*b* are formed side by side on the front side and the rear side.

The primary coil 24*a* includes first and second via conductors 2 and 3 provided so as to pass through the first and second via holes 23*a* and 23*b* formed in rows on the front side and just rearward, and the first and second surface conductors 4 and 5 respectively connected to ends of the first and second via conductors 2 and 3.

A conductive material such as a conductive paste or a copper wire can be used as the first and second via conductors 2 and 3. In the tenth embodiment, copper wires are used as the first and second via conductors 2 and 3, and the first and second via conductors 2 and 3 are joined to the first and second surface conductors 4 and 5 by soldering using solder films provided in advance in the via holes. However, when a plastically deformable conductive material such as a copper wire is used as the first and second via conductors 2 and 3, plug portions 2*a*, 2*b*, 3*a*, and 3*b* may, of course, be respectively formed at ends of the via conductors 2 and 3 in the surface conductors 4 and 5 like in the first to fifth embodiments.

Like the primary coil 24*a*, the secondary coil 24*b* includes via conductors 2 and 3 provided so as to pass through the via holes 23*a* and 23*b* formed in rows on the rear side and just forward, the first and second surface conductors 4 and 5 respectively connected to ends of the via conductors 2 and 3, and second surface conductors (terminal members) 6 and 6.

The first resin substrates 21*a* and 21 *b* of the laminated resin substrate 30 have on their inner surfaces the adhesive layers 31 and 31 containing an adhesive component. The third resin substrate 32 has the adhesive layers 31 on its both front and back surfaces and on the inner surfaces of the receiving portion 32*a*. However, the third resin substrate 32 does not necessarily have any of the adhesive layers 31 if the adhesive layers 31 are formed on the inner surfaces of the first resin substrates 21*a* and 21 *b*.

The magnetic core 1 composed of a magnetic body is a molded body obtained by forming a soft magnetic flat metal powder into a sheet, then laminating a plurality of such sheets, and then press-molding them into a flat plate. This soft magnetic flat metal powder is oriented in the plane of the flat plate.

In this invention, when the easy magnetization axis, i.e. the flat powder, is oriented in the plane, there is an advantage in that the magnetic permeability in the in-plane direction increases.

Using the press molding for manufacturing the magnetic core 1, there is an advantage in that even if a pressing force is applied to the molded body, no crack of the molded body occurs and further its magnetic properties do not change, and therefore, the molded body can be easily enclosed in the substrate.

The magnetic flux generated when the primary coil 24*a* and the secondary coil 24*b* are energized circulates in the plane of the flat plate. The magnetic core 1 is applied with a pressing force along with the laminated resin substrate and is integrated with the laminated resin substrate. The adhesive component is impregnated in pores of the magnetic core 1.

Herein, the porosity of the molded body forming the magnetic core 1 is preferably 5 vol % or more at which the adhesive component of the adhesive layers can be impregnated into the molded body to firmly integrate together the substrate and the molded body to provide both elasticity and a moderate deformation margin, while, it is preferably 25 vol % or less at which the metal filling ratio and the strength do not become insufficient. The adhesive component is not impregnated if the porosity is less than 5 vol %. Herein, the molded body contains a soft magnetic flat metal powder and a binder binding the soft magnetic flat metal powder. The volume ratio of the binder component is preferably 10 vol % or more and 45 vol % or less, and more preferably 10 vol % or more and 20 vol % or less. This is because if it is less than 10 vol %, the strength becomes insufficient, while, if it is greater than 45 vol %, the press-resistant strength becomes insufficient (the metal component ratio becomes high).

Although the powder is a metal material, since the molded body is configured such that the powder is bound by the insulator, it is excellent in frequency characteristics and it is not a brittle material as different from a ferrite and thus is durable in press molding.

The volume ratio of the soft magnetic flat metal powder to the molded body is preferably 55 vol % or more. Further, it is more preferable to further increase the metal component ratio by setting the volume ratio to 65 vol % or more. This is because since the molded body contains the 55 vol % or more soft magnetic metal component, a high magnetic permeability equivalent to a ferrite is obtained while having a high saturation magnetic flux density. Further, the metal component ratio can be made high by setting the volume ratio of the metal component to 65 vol % or more.

As described above, according to the sixth to tenth embodiments of this invention, the magnetic core composed of the molded body of the soft magnetic metal powder having the flat shape is press-enclosed in the laminated resin substrate so as to be integrated with the laminated resin substrate and the molded body is configured such that the porosity by volume ratio is 5 vol % or more and 30 vol % or less, that the binder component binding the metal powder is 10 vol % or more and 40 vol % or less, and that the soft magnetic metal powder component is 55 vol % or more and 85 vol % or less. Accordingly, in integral formation with the laminated resin substrate, the molded body is integrated with the resin substrate without being broken, while the molded body has a high magnetic permeability and a high saturation magnetic flux density. As a result, the coil with a high inductance can be obtained in the state where the magnetic core 1 is enclosed in the laminated resin substrate.

Further, in the sixth to tenth embodiments of this invention, it is not necessary to provide an air gap around the magnetic core embedded in the resin substrate and, further, it is configured that the laminate forming pressure to the laminated resin substrate is directly exerted also on the magnetic core which is enclosed. Therefore, the volume of the magnetic core embedded in the resin substrate can be made large and the reliability is improved.

Further, in the sixth to tenth embodiments of this invention, since the magnetic core 1 composed of the magnetic body has 5 vol % or more pores, the magnetic core 1 has both elasticity and a moderate deformation margin and thus is not cracked due to pressing. Further, since the magnetic core 1 has 5 vol % or more pores so that the adhesive component of the resin substrate is impregnated into the pores, the resin substrate and the magnetic core 1 can be joined and integrated together.

Further, in this invention, since the magnetic core material formed so that the soft magnetic flat metal powder is oriented in the flat plane formed by the laminated substrate embedded type inductor is used as the magnetic core 1 and since the magnetic core 1 contains the 55 vol % or more metal powder, i.e. the 55 vol % or more metal component, the magnetic core 1 has superimposition characteristics twice or more that of an NiZn ferrite and further has high-frequency characteristics equivalent to that of an NiZn ferrite excellent in frequency characteristics, as different from a metal ribbon or the like having a high relative permeability.

Further, according to the sixth to tenth embodiments of this invention, since the coil is formed using a plurality of layers of conductor patterns formed on a double-sided copper foil substrate or a single-sided copper foil substrate, it is possible to gain a cross-sectional area of a coil conductor and simultaneously to reduce an increase in AC electric resistance due to skin effect.

Further, in the manufacture of the laminated substrate embedded type inductors of the sixth to tenth embodiments of this invention, the free-cutting magnetic core is enclosed in the substrate and then the via machining is applied to the magnetic core so that the coil current path passing through the magnetic core embedded in the resin substrate can be formed. Since the via machining is carried out after the magnetic core is embedded in the substrate, the occurrence of crack or chip of the magnetic body due to the via machining is prevented.

The laminated substrate embedded type inductors according to the embodiments of this invention can, of course, be applied to inductance elements of the transformer-type coupling type, the couple L-type coupling type, and the type with slit or gap.

EXAMPLES

Hereinbelow, Examples of this invention will be described with reference to the drawings.

Example 1

I. First, the manufacture of sheet-shaped inductors according to an Example of this invention and Comparative Examples will be described.

Figure 15A:
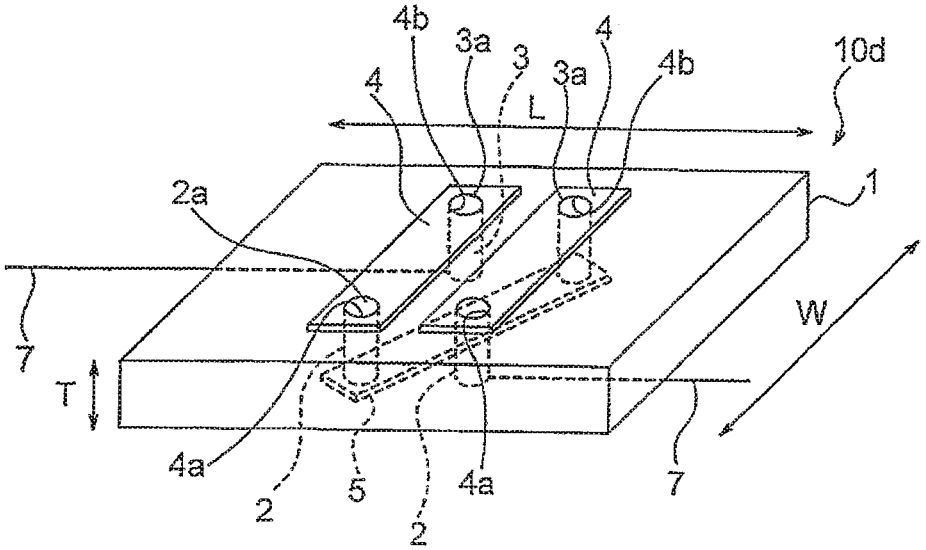
FIG. 15A is a perspective view showing a sheet-shaped inductor according to Example 1 of this invention and FIG. 15B a plan view showing the sheet-shaped inductor according to Example 1 of this invention.
Figure 15B:
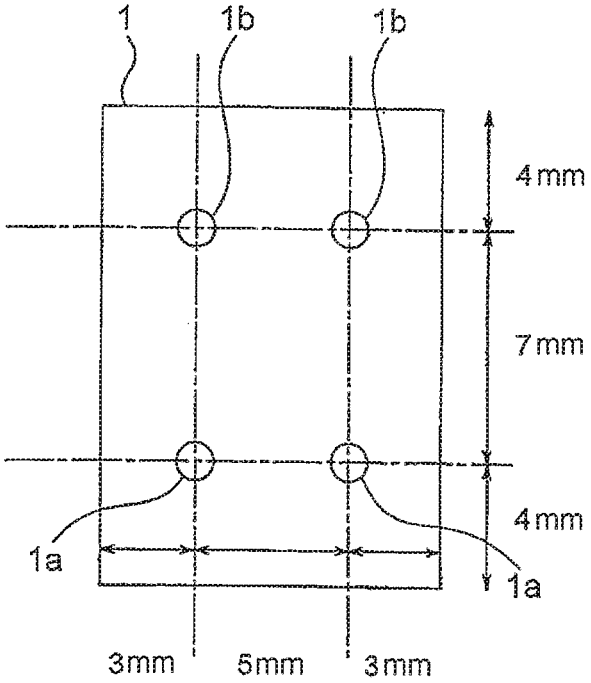

FIG. 15A and FIG. 15B are a perspective view and a plan view showing a sheet-shaped inductor according to Example 1 of this invention.

As a material powder of a soft magnetic metal, a gas atomized powder of an Fe—Si—Al-based alloy (Sendust) having an average particle size D50 of 55 μm was used. In order to flatten the shape of the powder, forging was applied to the material powder for 8 hours using a ball mill and then a heat treatment was carried out in a nitrogen atmosphere at 700° C. for 3 hours, thereby producing a Sendust powder as a metal powder having a flat shape. The produced soft magnetic flat metal powder had an average major axis (Da) of 60 μm, an average maximum thickness (ta) of 3 μm, and an average aspect ratio (Da/ta) of 20. The soft magnetic flat metal powder was mixed with a thickener and a thermosetting binder component, thereby producing a slurry. Ethanol was used as a solvent. As the thickener, polyacrylic acid ester was used. As the thermosetting binder component, methyl-based silicone resin was used.

Using the slot die method, the slurry was coated on a PET (polyethylene terephthalate) film. Thereafter, drying was carried out at a temperature of 60° C. for 1 hour to remove the solvent, thereby obtaining a sheet-shaped preliminary molded body. In this event, without the application of a magnetic field, the soft magnetic flat metal powder was oriented in the plane of the preliminary molded body.

Using a cutting die, the preliminary molded body was cut into a rectangle with a width of 15 mm and a length of 10 mm. Four preliminary molded bodies cut were laminated and enclosed in a metal mold. Press molding was applied to the enclosed preliminary molded bodies at 150° C. at a molding pressure of 20 kg/cm$^2$ for 1 hour.

In order to remove the molding strain, a heat treatment was carried out in a nitrogen atmosphere under conditions of 350° C. and 1 hour, thereby manufacturing a sheet-shaped inductor.

As shown in FIG. 15A, after the press molding, a molded body (magnetic core 1) with a thickness (T) of 0.9 mm, a width (W) of 15 mm, and a length (L) of 11 mm was obtained.

Thereafter, as shown in FIG. 15B, via holes 1*a* and 1 *b* with a diameter of 0.8 mm were provided at predetermined positions of the molded body 1 by drilling. Then, this molded body 1 was heat-treated in a nitrogen atmosphere under conditions of 600° C. and 1 hour, thereby producing a magnetic core 1. The magnetic core 1 had a value of 10 kΩ·cm or more as a volume resistivity. The density of the magnetic core 1 was 4.9 g/cc and the volume filling ratio of the metal component obtained from this density was about 67 vol %.

As shown in FIG. 15A, copper wires with no insulating coating each having a diameter of 0.8 mm and a length of 1.8 mm were produced and used as first and second via conductors 2 and 3 for insertion into the via holes. Further, a copper plate with no insulating coating having a width of 2 mm and a thickness of 0.3 mm was cut into pieces with a predetermined length and holes with a diameter of 0.8 mm were formed by drilling at positions shown in FIG. 15B to serve as plug holes 4*a*, 4*b*, 5*a*, and 5*b* for joining with the first and second via conductors 2 and 3 so that the copper plates were used as first and second surface conductors 4 and 5.

The first and second via conductors 2 and 3 were inserted into the magnetic core 1 obtained as described above, and the first and second surface conductors 4 and 5 were disposed at predetermined positions. Then, the magnetic core 1 with the conductors was sandwiched between stainless steel plates and pressed at 15 kgf so that the first and second via conductors 2 and 3 and the first and second surface conductors 4 and 5 were joined together. It was confirmed that, at joined portions between the first and second via conductors 2 and 3 and the first and second surface conductors 4 and 5, both ends 2*a* and 2*b*, 3*a* and 3*b* of the first and second via conductors were deformed due to the pressing force so that the diameter of the first and second via conductors was increased to be greater than the initial diameter of 0.8 mm. Further, it was confirmed that the surface conductors were buried inward from two flat surfaces of the magnetic core 1. Then, a sheet-shaped inductor 10*d* thus assembled was heat-treated in a nitrogen atmosphere under conditions of 650° C. and 1 hour to cause diffusion joining at the joined portions between the plug portions of the first and second via conductors 2 and 3 and the plug holes of the first and second surface conductors 4 and 5, thereby reducing the electric resistance at the joined portions between the plug portions and the plug holes. While there is a possibility that the organic component in the binder may be thermally decomposed by this heat treatment so as to be discharged as carbon dioxide, if the soft magnetic flat metal powder is coated with a $SiO_2$-containing insulating binding film in advance, the soft magnetic flat metal powder particles are bound together via the $SiO_2$-containing insulating binding film by the heat treatment, thus substituting at least a part of the function of the binder, so that it is possible to maintain the binding force between the soft magnetic flat metal powder particles.

Comparative Examples 2 to 4

The manufacture of sheet-shaped inductors according to Comparative Examples will be described.

Cutting and perpendicular polishing were applied to commercial Ni—Zn-based ferrite sintered bodies, thereby producing plate-shaped Ni—Zn-based ferrite magnetic cores each having a width of 15 mm, a length of 10 mm, and a thickness of 0.9 mm, i.e. the same shape as shown in FIG. 15A. With respect to the magnetic permeability of the NiZn-based ferrite sintered bodies, use was made of three kinds of materials having 200, 260, and 550 as real number components of relative permeabilities at 1 MHz. Via holes with a diameter of 0.8 mm were provided at predetermined positions of the respective sintered bodies by ultrasonic machining, thereby producing magnetic cores of Comparative Examples 2, 3, and 4. These magnetic cores each had a value of 10 kΩ·cm or more as a volume resistivity.

As shown in FIG. 15A, copper wires with no insulating coating each having a diameter of 0.8 mm and a length of 1.8 mm were produced and used as via conductors 2 and 3 for insertion into the via holes. Further, a copper plate with no insulating coating having a width of 2 mm and a thickness of 0.3 mm was cut into pieces with a predetermined length and holes with a diameter of 0.8 mm were formed by drilling at positions shown in FIG. 15B to serve as plug holes 4*a*, 4*b*, 5*a*, and 5*b* for joining with the first and second via conductors 2 and 3 so that the copper plates were used as first and second surface conductors 4 and 5.

The first and second via conductors were inserted into each of the magnetic cores obtained as described above, and the first and second surface conductors 4 and 5 were disposed at predetermined positions. Then, each magnetic core with the conductors was sandwiched between stainless steel plates and pressed at 15 kgf so that the via conductors and the surface conductors were joined together. It was confirmed that, at joined portions between the via conductors and the surface conductors, the via conductors were deformed due to the pressing force so that the diameter of the via conductors was increased to be greater than the initial diameter of 0.8 mm. Then, each of sheet-shaped inductors thus assembled was heat-treated in a nitrogen atmosphere under conditions of 650° C. and 1 hour to cause diffusion joining at the joined portions between the via conductors and the surface conductors, thereby reducing the electric resistance at the joined portions.

II. Next, evaluation of various properties of the sheet-shaped inductors according to the Example of this invention and the Comparative Examples will be described.

Figure 16:
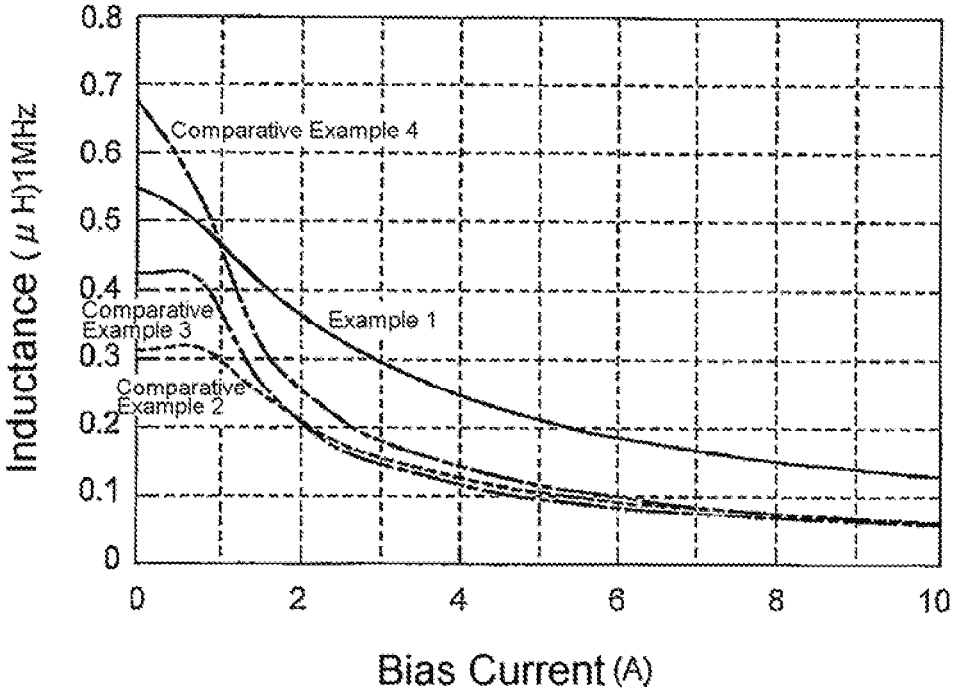
FIG. 16 is a diagram showing the results of measuring the inductance at 1 MHz of the sheet-shaped inductor according to Example 1 of this invention, wherein those for Comparative Examples 2 to 4 are also shown for comparison.
Figure 17:
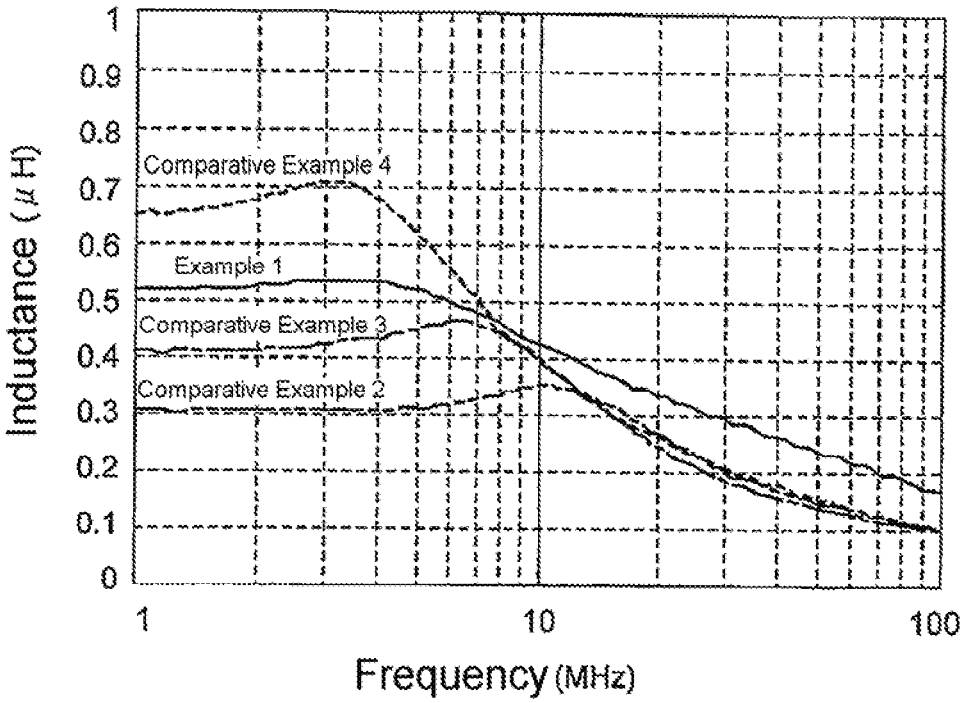
FIG. 17 is a diagram showing the results of measuring the frequency dependence of the inductance of the sheet-shaped inductor according to Example 1 of this invention.

With respect to the sheet-shaped inductors of Example 1 and the Comparative Examples 2 to 4 thus obtained, FIG. 16 shows the results of measuring the inductance at 1 MHz, FIG. 17 shows the results of measuring the frequency dependence of the inductance, and Table 1 shows a summary of the breakage occurrence ratio in the manufacture and the property evaluation results. LCR meter HP4284A of Hewlett-Packard (currently, Agilent Technologies) was used for measuring the inductance at 1 MHz, while an impedance analyzer 4294A of Agilent Technologies was used for measuring the frequency characteristics of the inductance.

As shown in FIG. 17, the sheet-shaped inductor of Example 1 of this invention has an inductance equivalent to the Ni—Zn-based ferrite inductors and a reduction in inductance due to eddy current loss or the like does not occur at 1 MHz or more. Further, it is confirmed that the inductor of Example 1 has high inductance up to a frequency equivalent to or higher than those of Comparative Examples 2 to 4 in which the Ni—Zn-based ferrite featured in having excellent high-frequency characteristics was used as the magnetic core. This fact simultaneously shows that even if the high-temperature heat treatment is carried out in the state where the coil portion formed by the via conductors and the surface conductors and the magnetic core of Example 1 are closely adhered to each other, the coil is not short-circuited.

Further, as shown in FIG. 16 and Table 1, it is seen that the inductance when the bias current is increased is significantly excellent in the sheet-shaped inductor of Example 1 of this invention compared to the inductors using the Ni—Zn-based ferrite magnetic cores of Comparative Examples 2 to 4. Specifically, for example, an inductance value when the bias current is set to 5 A is approximately twice compared to the inductors using the Ni—Zn-based ferrite magnetic cores of Comparative Examples 2 to 4. This is because the metal powder having a high saturation magnetic flux density compared to the Ni—Zn-based ferrite is used as the magnetic core material. It is seen that the sheet-shaped inductor having the structure of Example 1 of this invention is an inductor whose inductance cannot be easily reduced even if a large current flows and which is thus suitable for large-current conduction.

TABLE 1

| Test Level | Magnetic Core Breakage Occurrence Ratio in Manufacture of Inductor | Inductance at Frequency of 1 MHz and DC Bias Current of 5A (μH) |
|---|---|---|
| Example 1 | 0/10 | 0.21 |
| Comparative Example 2 | 7/10 | 0.1 |
| Comparative Example 3 | 8/10 | 0.105 |
| Comparative Example 4 | 8/10 | 0.115 |

While Example 1 of this invention has been described, the kind and addition amount of an organic binding material such as polyacrylic acid ester or methyl-based silicone resin used as the thickener or the molding binder should be appropriately selected and adjusted according to the properties of a metal powder subjected to molding. In particular, it is readily understood that if the addition amount of a molding binder is adjusted approximately in proportion to the specific surface area of the powder, it is possible to obtain a favorable result similar to that of the Example described above.

While the conductor with no insulating coating was used as the constituent element of the coil, a conductor with an insulating coating may be used at an appropriate portion. Further, when joining the conductors together by the pressing force, fusing or current-pulse conduction may be simultaneously carried out, thereby facilitating the joining. Although the diffusion joining at the joined portions by the heat treatment is not essential, the diffusion joining may be facilitated by interposing metal powder nano-particles at the joined portions where necessary.

The foregoing description is for explaining the effects of the sheet-shaped inductors according to the embodiments of this invention and is not intended to limit the invention described in the claims or to reduce the scope of the claims. Further, the structures of the respective portions and the kinds of soft magnetic metal powders for use according to this invention are not limited to those in the embodiments described above and can be changed in various ways within the technical scope described in the claims.

Example 2

I. A press-resistant strength test of a magnetic core to be embedded in a resin substrate and a test of joining of a magnetic core with a resin substrate will be described.

As a material powder of a soft magnetic metal, a water atomized powder of an Fe-3.5Si-2Cr alloy having an average particle size D50 of 33 μm was used. In order to flatten the shape of the powder, forging was applied to the material powder for 8 hours using a ball mill and then a heat treatment was carried out in a nitrogen atmosphere at 500° C. for 3 hours, thereby obtaining an Fe-3.5Si-2Cr powder having a flat shape. The soft magnetic flat metal powder was mixed with ethanol as a solvent, polyacrylic acid ester as a thickener, and methylphenyl-based silicone resin as a thermosetting binder component, thereby producing a slurry. Using the slot die method, the slurry was coated on a PET (polyethylene terephthalate) film. Then, drying was carried out at 60° C. for 1 hour to remove the solvent, thereby obtaining a preliminary molded body. In this event, the addition amount of the methyl-based silicone resin to 100 grams of the soft magnetic flat metal powder was set to predetermined levels between 2 wt % and 20 wt %.

Using a cutting die, the preliminary molded body was cut into a square with a width of 100 mm and a length of 100 mm. A predetermined number of obtained pieces were laminated and enclosed in a metal mold where press molding was applied thereto at 150° C. at a molding pressure of 2 MPa for 1 hour. Then, this molded body 1 was heat-treated in a nitrogen atmosphere under conditions of 550° C. and 1 hour. In this manner, three test pieces for a press-resistant strength test were produced for each of the binder addition amount levels. The thickness of the test piece was 0.3 mm.

The molding density of the test piece was measured by the Archimedes method. Herein, the true density of only the flattened Fe-3.5Si-2Cr alloy measured by the Archimedes method was 7.6 g/cc and the true density of the methylphenyl-based silicone resin after hardening was 1.3 g/cc. The methylphenyl-based silicone resin showed a 20 wt % heating loss under the heat treatment conditions of 550° C. and 1 hour in the nitrogen atmosphere. The thickener component was almost completely decomposed thermally by the heat treatment and did not remain in the magnetic core. From these numerical values, the volume filling ratio of the metal component, the volume filling ratio of the methylphenyl-based silicone resin component, i.e. the binder component, after hardening, and the porosity were calculated with respect to the heat-treated molded body of the soft magnetic flat metal powder.

The test piece was sandwiched between two stainless steel plates mirror-polished and having a thickness of 6 mm and was pressed at 15 MPa using a hydraulic pressing machine. After confirming the presence/absence of occurrence of crack or peeling, a press-resistant strength test was conducted.

Further, heat-treated molded bodies each having a width of 100 mm, a length of 100 mm, and a thickness of 0.3 mm obtained in the same manner as the test pieces for the press-resistant strength test were each disposed between two prepregs each having a width of 100 mm, a length of 100 mm, and a thickness of 0.3 mm and then press-adhered together under conditions of 180° C., 3 MPa, and 1 hour. Then, a laminate of the molded body of the flat metal powder and the prepregs heated to be cured was cut into pieces each having a width of 15 mm, a length of 15 mm, and a thickness of 0.9 mm using a dicing saw, thereby obtaining 36 pieces in total. Each piece had four surrounding sides with cut surfaces by the dicing saw. These pieces were heated for 1 minute on a hot plate heated to 350 degrees. Then, the number of the test pieces in which a phenomenon of separation between the molded body of the soft magnetic flat metal powder and the prepreg layers occurred due to peeling therebetween was counted and adopted as an index for evaluating a state of joining with the resin substrate.

TABLE 2

| Addition Amount of Silicone Resin (wt %) | Volume Filling Ratio of Metal Component (vol %) | Volume Filling Ratio of Binder Component (vol %) | Porosity (vol %) | Press-Resistant Strength Test Result | Presence/Absence of Occurrence of Peeling in Cut Piece of Resin Substrate Laminate | Notes |
|---|---|---|---|---|---|---|
| 2 | 60 | 7 | 33 | crack occurred | (peeling occurred in a molded body before heating) | Comparative Example |
| 2.5 | 65 | 9.5 | 25.5 | no crack | no piece with peeling | This Invention |
| 3 | 70 | 12 | 18 | | | |
| 4 | 68 | 16 | 16 | | | |
| 5 | 65 | 19 | 16 | | | |
| 6 | 62 | 22 | 16 | | | |
| 8 | 59 | 27.5 | 13.5 | | | |
| 10 | 55 | 32 | 13 | | | |
| 12 | 53 | 37 | 10 | | | |
| 14 | 52 | 42.5 | 5.5 | | | |
| 16 | 49 | 46.5 | 4 | | | |
| 18 | 47.5 | 50 | 2.5 | | peeling occurred | Comparative Example |
| 20 | 45.5 | 53 | 1.5 | crack occurred | | |

The results of the evaluation described above are summarized and shown in Table 2. When the volume filling ratio of the binder component was 7 vol % and the porosity was 33 vol %, crack occurred in the press-resistant strength test due to the strength of the molded body being insufficient and, further, peeling occurred at the flat metal powder molded body portion of the cut piece of the resin substrate laminate. Then, when the volume filling ratio of the binder component was 9.5 vol % or more and 46.5 vol % or less and the porosity was 4 vol % or more and 25.5 vol % or less, crack did not occur in the press-resistant strength test and, simultaneously, peeling also did not occur in the cut piece of the resin substrate laminate. This is considered to be because since the amount of the binder component was adequate, the molded body had sufficient strength, and since the porosity was adequate, an adhesive component of the prepregs was impregnated into pores of the molded body so that the molded body and the prepregs were integrated together to keep high the interlayer strength between the molded body and the prepregs. Then, when the porosity was 2.5 vol % or less, peeling occurred in the cut piece of the resin substrate laminate. This is because since the porosity of the molded body was too low, an adhesive component of the prepregs was not sufficiently impregnated into pores of the molded body so that the interlayer strength between the molded body and the prepregs was insufficient. Then, when the binder component was 53 vol % or more, crack occurred in the press-resistant strength test. This is because, an effect that since the porosity of the molded body was too low, the elasticity of the molded body was reduced so that a pressing force was not buffered, and an effect that since the volume filling ratio of the metal component acting also as a filler for maintaining the strength of the molded body was too low, the strength of the molded body was not maintained, were synergistically exhibited.

On the whole, when the structure is controlled so that the volume filling ratio of the binder component is 9.5 vol % or more and 50 vol % or less and that the porosity is 4 vol % or more and 25.5 vol % or less, there is obtained an excellent result that crack of the molded body does not occur in the press-resistant strength test and that peeling does not occur in the cut piece of the resin substrate laminate.

II. The manufacture of a magnetic core of a sheet-shaped inductor of Example 1 will be described.

As a material powder of a soft magnetic metal, a gas atomized powder of an Fe—Si—Al-based alloy (Sendust) having an average particle size D50 of 55 μm was used. In order to flatten the shape of the powder, forging was applied to the material powder for 8 hours using a ball mill and then a heat treatment was carried out in a nitrogen atmosphere at 700° C. for 3 hours, thereby obtaining a Sendust powder having a flat shape. The produced flat metal powder had an average major axis (Da) of 60 μm, an average maximum thickness (ta) of 3 μm, and an average aspect ratio (Da/ta) of 20. The aspect ratio of the flat metal powder was obtained by impregnating a resin into the compressed metal powder to harden it, then polishing this hardened body, and then observing the shape of the flat metal powder on a polished surface by a scanning electron microscope. Specifically, the major axis (D) and the thickness (t) of a thickest portion were measured with respect to 30 flat metal powder particles, thereby calculating an average value of aspect ratios (D/t).

The Sendust powder was mixed with ethanol as a solvent, polyacrylic acid ester as a thickener, and methyl-based silicone resin as a thermosetting binder component, thereby producing a slurry. Using the slot die method, the slurry was coated on a PET (polyethylene terephthalate) film. Then, drying was carried out at 60° C. for 1 hour to remove the solvent, thereby obtaining a preliminary molded body.

Using a cutting die, the preliminary molded body was cut into a rectangle with a width of 15 mm and a length of 10 mm. A predetermined number of obtained pieces were laminated and enclosed in a metal mold where press molding was applied thereto at 150° C. at a molding pressure of 2 MPa for 1 hour. The thickness of a molded body after the press molding was 0.9 mm.

In order to produce a magnetic core equivalent to the magnetic core 1 of Example 1, as shown in FIG. 15A and FIG. 15B, via holes with a diameter of 0.8 mm were provided at predetermined positions of the molded body 1 by drilling. Then, this molded body 1 was heat-treated in a nitrogen atmosphere under conditions of 650° C. and 1 hour, thereby producing a magnetic core 1 of Example 1. The magnetic core 1 had a value of 10 kΩ·cm or more as a volume resistivity. The density of the magnetic core was 4.9 g/cc and the volume filling ratio of the metal component obtained from this density was about 67 vol %, while the volume filling ratio of the methyl-based silicone resin component after hardening was about 18 vol % and the porosity was about 15 vol %. The thickener component was almost completely decomposed thermally by the heat treatment and did not remain in the magnetic core.

III. Next, the manufacture of magnetic cores of sheet-shaped inductors of Comparative Examples 5, 6, and 7 will be described.

Cutting and perpendicular polishing were applied to commercial Ni—Zn-based ferrite sintered bodies, thereby producing plate-shaped Ni—Zn-based ferrite magnetic cores each having a width of 15 mm, a length of 10 mm, and a thickness of 0.9 mm. With respect to the magnetic permeability of the NiZn-based ferrite sintered bodies, use was made of three kinds of materials having 200, 260, and 550 as real number components of relative permeabilities at 1 MHz. Via holes with a diameter of 0.8 mm were provided at predetermined positions of the respective sintered bodies by ultrasonic machining, thereby producing magnetic cores of Comparative Examples 5, 6 and 7. These magnetic cores each had a value of 10 kΩ·cm or more as a volume resistivity.

IV. The manufacture of conductor components for forming a coil will be described.

Copper wires with no insulating coating each having a diameter of 0.8 mm and a length of 1.8 mm were produced and used as via conductors for insertion into the via holes. Further, a copper plate with no insulating coating having a width of 2 mm and a thickness of 0.3 mm was cut into pieces with a predetermined length and holes with a diameter of 0.8 mm were formed by drilling at predetermined positions to serve as plug holes for joining with the via conductors so that the copper plates were used as surface conductors.

Further, the manufacture of inductors of Example 1 and Comparative Examples 5, 6, and 7 will be described.

The via conductors were inserted into each of the magnetic cores obtained as described above, and the surface conductors were disposed at predetermined positions. Then, each magnetic core with the conductors was sandwiched between stainless steel plates and pressed at 15 kgf so that the via conductors and the surface conductors were joined together. A schematic diagram of the structure of an obtained inductance element is the same as that shown in FIG. 15A and FIG. 15B.

V. Next, the manufacture of a laminated substrate embedded type inductor of Example 2 will be described.

Figure 18:
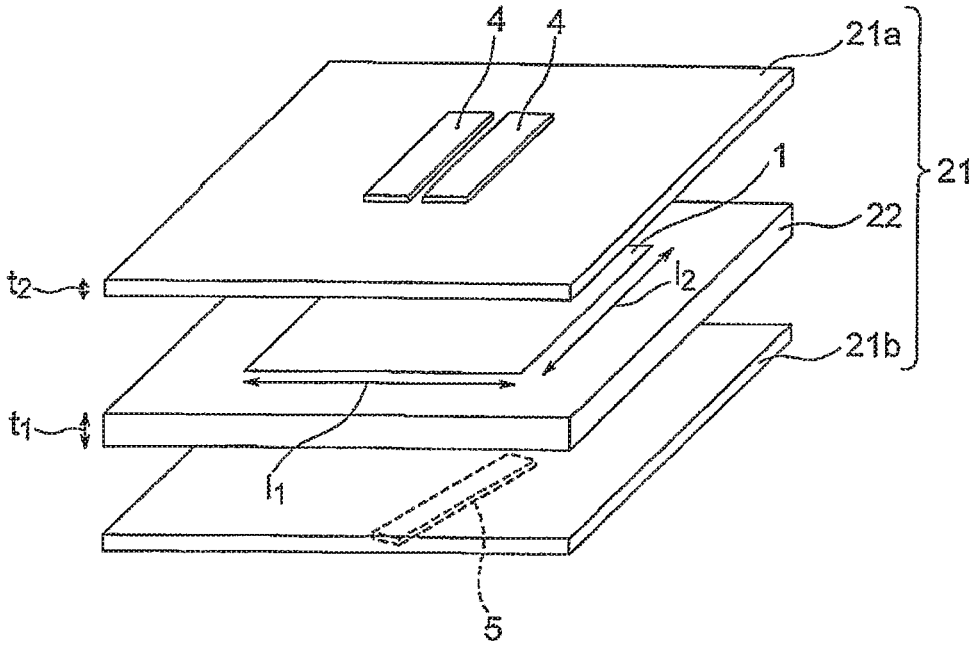
FIG. 18 is an exploded perspective view of an inductor according to Example 2 of this invention.
Figure 19:
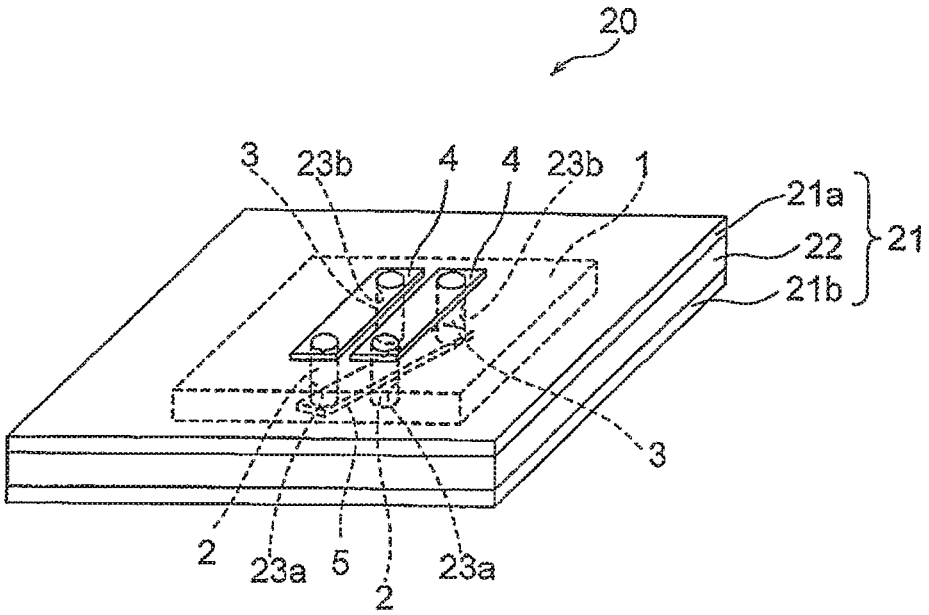
FIG. 19 is a perspective view of the inductor of FIG. 18.

As shown in FIGS. 18 and 19, in order to manufacture an inductor, in which a magnetic core is embedded in a substrate, according to Example 2 of this invention, a preliminary molded body obtained in the same manner as in Example 1 was cut into a rectangle with a width of 15 mm and a length of 10 mm using a cutting die. A predetermined number of obtained pieces were laminated and enclosed in a metal mold where press molding was applied thereto at 150° C. at a molding pressure of 2 MPa for 1 hour. The thickness t1 of a molded body 1 after the press molding was 0.9 mm. The molded body 1 was heat-treated in a nitrogen atmosphere under conditions of 650° C. and 1 hour, thereby producing a magnetic body (magnetic core) 1. Like the structure shown in FIGS. 18 and 19, this magnetic core 1 was disposed at a central portion of a laminate formed by laminating three prepregs each having a hole with a width of 15 mm and a length of 10 mm and each having a thickness of 0.3 mm, then single-sided copper foil substrates each formed with a conductor pattern forming part of coil conductors and each having a thickness of 0.5 mm were disposed as first resin substrates 21*a* and 21*b* on upper and lower sides of the laminate, and then press lamination was carried out under conditions of 3 MPa, 180° C., and 1 hour. Via holes 23*a* and 23*b* with a diameter of 0.8 mm were provided at predetermined positions, corresponding to those in FIG. 19, of this pressed laminate by drilling. Copper wires with a diameter of 0.8 mm were inserted as via conductors 2 and 3 into the via holes. The copper wires and the conductor patterns formed on the single-sided copper foil substrates were joined together by soldering, thereby manufacturing an inductor in which the magnetic body was embedded in the laminated resin substrate and which had the same shape as that of the inductor shown in FIGS. 18 and 19.

Figure 20:
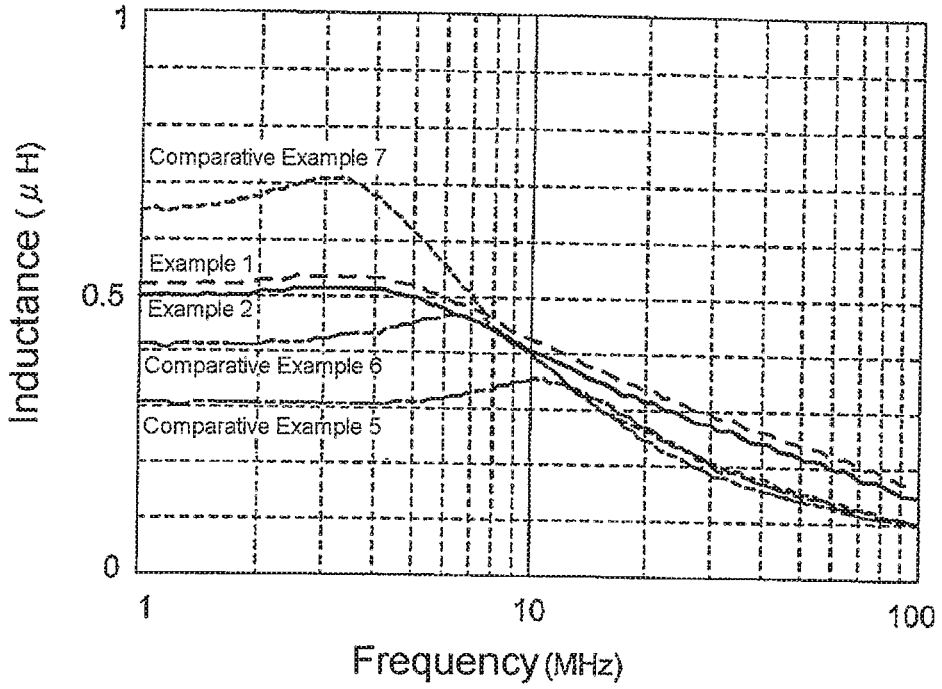
FIG. 20 is a diagram showing the frequency characteristics of the inductance of the inductors according to Examples 1 and 2 of this invention, wherein the measurement results of inductors according to Comparative Examples 5, 6, and 7 are also shown for comparison.
Figure 21:
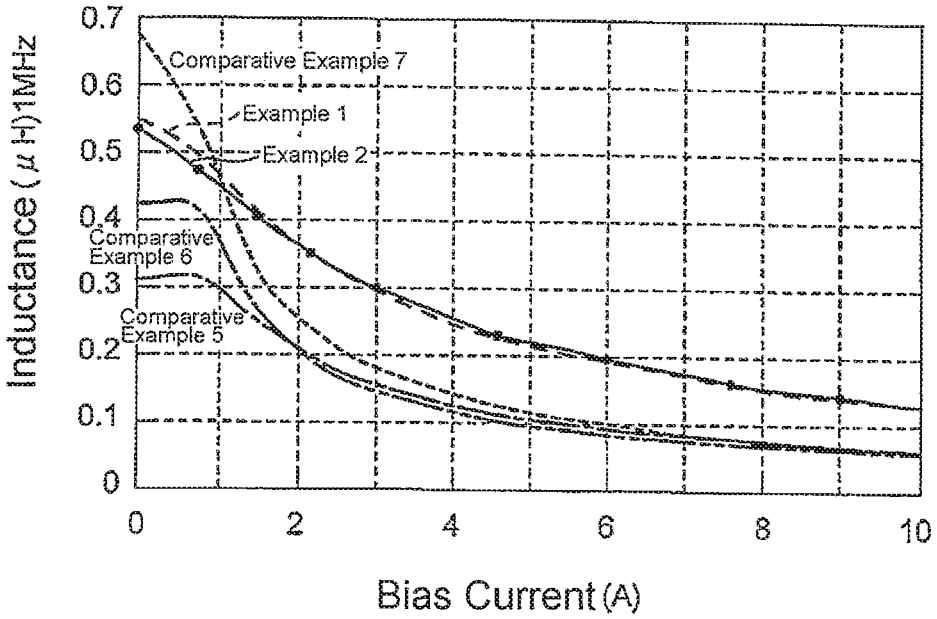
FIG. 21 is a diagram showing the bias current dependence of the inductance at 1 MHz of the inductors according to Examples 1 and 2 of this invention, wherein the measurement results of the inductors according to Comparative Examples 5, 6, and 7 are also shown.

With respect to the inductors of Example 1, Comparative Examples 5, 6, and 7, and Example 2 thus obtained, FIG. 20 shows the results of measuring the frequency characteristics of the inductance and FIG. 21 shows the results of measuring the bias current dependence of the inductance at 1 MHz. LCR meter HP4284A of Hewlett-Packard (currently, Agilent Technologies) was used for measuring the inductance at 1 MHz, while an impedance analyzer 4294A of Agilent Technologies was used for measuring the frequency characteristics of the inductance.

As shown in FIG. 20, the inductors of Examples 1 and 2 of this invention each have an inductance equivalent to the Ni—Zn-based ferrite inductance elements and a reduction in inductance due to eddy current loss or the like does not occur at 1 MHz or more. That is, it is confirmed that the inductors of Examples 1 and 2 each have high inductance up to a frequency equivalent to or higher than those of the inductors according to Comparative Examples 5 to 7 in which the Ni—Zn-based ferrite having excellent high-frequency characteristics was used as the magnetic core.

Further, as shown in FIG. 21, it is seen that the inductance when the bias current is increased is significantly excellent in the inductors according to Examples 1 and 2 of this invention compared to the inductance elements using the Ni—Zn-based ferrite magnetic cores of Comparative Examples 5 to 7. Specifically, for example, an inductance value when the bias current is set to 5 A is approximately twice compared to the inductance elements using the Ni—Zn-based ferrite magnetic cores of Comparative Examples 5 to 7. This is because the metal powder having a high saturation magnetic flux density compared to the Ni—Zn-based ferrite is used as the magnetic core material in Examples 1 and 2. It is seen that the inductance element having the structure of this invention is an inductor whose inductance cannot be easily reduced even if a large current flows and which is thus suitable for large-current conduction.

Further, as shown in FIG. 20 and FIG. 21, the characteristics of the inductance element of Example 2 in which the magnetic core is embedded in the resin substrate almost agree with the characteristics of the inductance element which is produced without embedding the magnetic core in the resin substrate and is given as Example 1. In other words, it is seen that, with the structure of the magnetic core 1 of Example 1 of this invention, not only there is no concern about damage to the magnetic core 1 due to a pressing force when the magnetic core is enclosed in the substrate, but also there is an advantage in that the excellent magnetic properties of the magnetic core 1 are maintained without change even after the magnetic core is enclosed in the substrate.

The foregoing description is for explaining the effects of the laminated resin substrate embedded type inductors according to the embodiments of this invention and is not intended to limit the invention described in the claims or to reduce the scope of the claims. Further, the structures of the respective portions and the kinds of soft magnetic metal powders for use according to this invention are not limited to those in the embodiments described above and can be changed in various ways within the technical scope described in the claims.

INDUSTRIAL APPLICABILITY

As described above, a sheet-shaped inductor and its manufacturing method according to this invention are applied to an inductor mounted in a power supply circuit of a small electronic device and its manufacturing method.

Further, a laminated substrate embedded type inductor of this invention can be used in a noise filter, an antenna, or the like.

DESCRIPTION OF SYMBOLS

1 magnetic core
1*a*, 23*a*, 28*a* first via hole
1*b*, 23*b*, 28*b* second via hole
2 first via conductor
2*a* one end (plug portion)
3 second via conductor
3*a* one end (plug portion)
3*b* the other end (plug portion)
4 first (substrate) surface conductor
4*a*, 5*a* first plug hole
4*b*, 5*b* second plug hole
5 second (substrate) surface conductor
6 second (substrate) surface conductor (terminal member)
6*a* plug hole
7 lead
8 coil
9 gap
10, 10*a*, 10*b*, 10*c*, 10*d*, 20 sheet-shaped inductor
11 primary coil
12 secondary coil
14 first (terminal-connection) surface conductor
14*a* side surface electrode
15 second (terminal-connection) surface conductor
15*a* side surface electrode
21, 29, 30 laminated substrate
21*a*, 21*b* first resin substrate
21*c* air vent hole
22 prepreg
24 coil
24*a* primary coil
24*b* secondary coil
25*a*, 25*b* second resin substrate
26 third (substrate) surface conductor
27 fourth (substrate) surface conductor
31 adhesive layer
32*a* receiving portion
32 third resin substrate

The invention claimed is:

1. A laminated substrate embedded type inductor comprising:
- a laminated resin substrate in which a pair of first resin substrates are laminated;
- a sheet-shaped magnetic core placed in the laminated resin substrate;
- via holes provided so as to pass through the laminated resin substrate and the magnetic core; and
- a coil formed via the via holes,
- wherein the laminated resin substrate contains an adhesive component,
- wherein the sheet-shaped magnetic core is a molded body obtained by forming a soft magnetic flat metal powder into a flat plate, the soft magnetic flat metal powder is oriented in a plane of the flat plate, and a generated magnetic flux of the coil circulates in the plane of the flat plate, and
- wherein the magnetic core is integrated with the laminated resin substrate so that the adhesive component is impregnated in pores of the magnetic core.

2. The laminated substrate embedded type inductor according to claim 1, wherein the molded body has a porosity of at least 5 vol % and at most 25 vol %.

3. The laminated substrate embedded type inductor according to claim 1, wherein the molded body contains the soft magnetic flat metal powder and a binder binding the soft magnetic flat metal powder and wherein a volume ratio of the binder component is at least 10 vol % and at most 45 vol %.

4. The laminated substrate embedded type inductor according to claim 1, wherein a volume ratio of the soft magnetic flat metal powder to the molded body is at least 55 vol %.

5. The laminated substrate embedded type inductor according to claim 1, wherein the coil comprises:
- via conductors provided so as to pass through the via holes; and
- surface conductors provided on surfaces of the laminated resin substrate and connected to the via conductors, and
- wherein each of the surface conductors has a thickness obtained by laminating two or more layers of conductor films each of at most 100 μm.

6. The laminated substrate embedded type inductor according to claim 5, wherein the first resin substrates each comprise a single-sided copper foil substrate and wherein each of the surface conductors comprises a conductor pattern formed on one surface of each single-sided copper foil substrate.

7. The laminated substrate embedded type inductor according to claim 1, further comprising second resin substrates respectively laminated on both surfaces of the laminated resin substrate, wherein the via holes are provided so as to further pass through the second resin substrates, and wherein the coil comprises:

via conductors provided so as to pass through the via holes; and inner conductors and surface conductors respectively provided on surfaces of the first and second resin substrates and connected to the via conductors.

8. The laminated substrate embedded type inductor according to claim 7, wherein the second resin substrates each comprise a double-sided copper foil substrate and wherein the inner conductors and the surface conductors comprise conductor patterns formed on both surfaces of each double-sided copper foil substrate.

9. The laminated substrate embedded type inductor according to claim 1, wherein the magnetic core is a molded body obtained by laminating a plurality of sheet-shaped molded bodies of the soft magnetic flat metal powder and press-molding the sheet-shaped molded bodies laminated.

10. The laminated substrate embedded type inductor according to claim 1, wherein each of the via holes is provided so as to pass through the magnetic core or the vicinity of the magnetic core.

11. A method of manufacturing the laminated substrate embedded type inductor according to claim 1, the method comprising:

placing the sheet-shaped magnetic core in the laminated resin substrate in which the pair of first resin substrates are laminated, the magnetic core comprising a molded body sheet of a mixture containing the soft magnetic flat metal powder and a binder, wherein the soft magnetic flat metal powder is oriented two-dimensionally in a flat plane of the molded body sheet which is the plane of the flat plate, wherein the molded body sheet has a porosity of at least 5 vol % and at most 25 vol %, and wherein a volume ratio of the soft magnetic flat metal powder to the molded body sheet is at least 65 vol % and at most 70 vol %;

forming the via holes to pass through the laminated resin substrate and the magnetic core; and forming the coil via the via holes, wherein the magnetic core is applied with a pressing force along with the laminated resin substrate so as to be integrated with the laminated resin substrate, thereby allowing the adhesive component to be impregnated into the pores of the magnetic core.

12. The method according to claim 11, wherein the coil comprises:

via conductors provided so as to pass through the via holes; and surface conductors provided on surfaces of the laminated resin substrate and connected to the via conductors, wherein each of the surface conductors has a thickness obtained by laminating two or more layers of conductor films each of at most 100 μm.

13. The method according to claim 11, wherein the first resin substrates each comprise a single-sided copper foil substrate and wherein each of the surface conductors comprises a conductor pattern formed on one surface of each single-sided copper foil substrate.

14. The method according to claim 11, wherein second resin substrates are provided so as to be respectively laminated on both surfaces of the laminated resin substrate, wherein the via holes are provided so as to further pass through the second resin substrates, and wherein the coil comprises:

via conductors provided so as to pass through the via holes; and inner conductors and surface conductors respectively provided on surfaces of the first and second resin substrates and connected to the via conductors.

15. The method according to claim 14, wherein the second resin substrates each comprise a double-sided copper foil substrate and wherein the inner conductors and the surface conductors comprise conductor patterns formed on both surfaces of each double-sided copper foil substrate.

16. The method according to claim 11, wherein each of the via holes is formed to pass through the magnetic core or a vicinity of the magnetic core.

* * * * *